US011684528B2

(12) United States Patent
Gupta

(10) Patent No.: US 11,684,528 B2
(45) Date of Patent: Jun. 27, 2023

(54) LOCKING SYSTEM OF A WHEELCHAIR

(71) Applicant: Toyota Motor North America, Inc., Plano, TX (US)

(72) Inventor: Parag Gupta, Colleyville, TX (US)

(73) Assignee: TOYOTA MOTOR NORTH AMERICA, INC., Plano, TX (US)

( * ) Notice: Subject to any disclaimer, the term of this patent is extended or adjusted under 35 U.S.C. 154(b) by 946 days.

(21) Appl. No.: 16/548,196

(22) Filed: Aug. 22, 2019

(65) Prior Publication Data

US 2021/0052446 A1 Feb. 25, 2021

(51) Int. Cl.
*A61G 5/00* (2006.01)
*A61G 5/10* (2006.01)

(52) U.S. Cl.
CPC ..... *A61G 5/101* (2013.01); *A61G 5/1029* (2013.01)

(58) Field of Classification Search
CPC ..... A61G 5/101; A61G 5/1029
USPC ..... 188/7
See application file for complete search history.

(56) References Cited

U.S. PATENT DOCUMENTS 5,228,709 A * 7/1993 Kao ..... A61G 5/128 280/5.2
8,167,317 B2 * 5/2012 Fast ..... A61G 5/1054 280/5.3
9,572,732 B2 2/2017 Beeri
2015/0173986 A1 * 6/2015 Beeri ..... A61G 5/104 280/5.28

FOREIGN PATENT DOCUMENTS

CN 203735793 U 7/2014
CN 104224458 A 12/2014
GB 2130977 B 8/1986
JP 3059969 B2 7/2000

* cited by examiner

*Primary Examiner* — James A Shriver, II
*Assistant Examiner* — Hilary L Johns
(74) *Attorney, Agent, or Firm* — Dinsmore & Shohl LLP

(57) ABSTRACT

A locking system of a wheelchair is disclosed. The locking system includes a locking member, an actuator, a locking frame, and an opening. The opening is disposed within the locking frame. The actuator is in communication with the locking member and is configured to move the locking member within the opening. The actuator is operable in a retracted operation state and an extended operation state. The actuator is configured to move the locking member in an upward direction when the locking system is set from the extended operation state to the retracted operation state. The actuator is configured to move the locking member in a downward direction when the locking system is set from the retracted operation state to the extended operation state, and the locking member is naturally biased in the extended operation state.

20 Claims, 18 Drawing Sheets

LOCKING SYSTEM OF A WHEELCHAIR

FIELD

The present specification generally relates to locking systems of a wheelchair, and more particularly, to locking systems that include a retractable locking member.

BACKGROUND

Conventionally, a wheelchair enables a user to move from one location to another location while the user is positioned in a seat or base portion of the wheelchair. Accordingly, wheelchairs may be utilized when walking is difficult or impossible for a user due to, for example, illness, injury, or disability. When a user desires to remain at a fixed location and/or stop using the wheelchair, the user may guide a locking pin of the wheelchair such that it engages a mating device located beneath the wheelchair (e.g., a floor of a vehicle) and lock the wheelchair.

However, while operating the wheelchair, the locking pin may contact the terrain and/or other objects located underneath the wheelchair. As such, the locking pin may break in response to contacting the terrain and/or other objects located underneath the wheelchair. Furthermore, in response to the locking pin contacting the terrain and/or other objects located underneath the wheelchair, the center of gravity of the wheelchair may change, thereby potentially dislodging the user from the wheelchair and/or causing the wheelchair to tip over during operation.

Accordingly, there is a need for a locking system that engages with a mating device and that is configured to avoid the terrain and/or objects located underneath the wheelchair while operating the wheelchair.

SUMMARY

In one embodiment, a locking system of a wheelchair is disclosed. The locking system includes a locking member, an actuator, a locking frame, and an opening. The opening is disposed within the locking frame. The actuator is in communication with the locking member and is configured to move the locking member within the opening. The actuator is operable in a retracted operation state and an extended operation state. The actuator is configured to move the locking member in an upward direction when the locking system is set from the extended operation state to the retracted operation state. The actuator is configured to move the locking member in a downward direction when the locking system is set from the retracted operation state to the extended operation state, and the locking member is naturally biased in the extended operation state.

In another embodiment, a wheelchair is disclosed and includes a wheelchair frame and a locking system that includes a locking member, an actuator, a locking frame, and an opening. The locking frame is coupled to the wheelchair frame of the wheelchair, and the opening is disposed within the locking frame. The actuator is in communication with the locking member and is configured to move the locking member within the opening, and the actuator is operable in a retracted operation state and an extended operation state. The actuator is configured to move the locking member in an upward direction when the locking system is set from the extended operation state to the retracted operation state. The actuator is configured to move the locking member in a downward direction when the locking system is set from the retracted operation state to the extended operation state, and the locking member is naturally biased in the extended operation state.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

BRIEF DESCRIPTION OF THE DRAWINGS

The embodiments set forth in the drawings are illustrative and exemplary in nature and are not intended to limit the subject matter defined by the claims. The following detailed description of the illustrative embodiments can be understood when read in conjunction with the following drawings, where like structure is indicated with like reference numerals and in which:

DETAILED DESCRIPTION

Referring generally to the figures, embodiments of the present disclosure are generally related to locking systems of wheelchairs. In some embodiments, the locking system is operable in a retracted operation state and an extended operation state. During the retracted operation state, a position of the locking member is adjusted such that it avoids the terrain and/or other objects located underneath the wheelchair. During the extended operation state, a position of the locking member is adjusted such that it can engage with a mating device located beneath the wheelchair and lock the wheelchair. Accordingly, the locking system described herein may improve the safety of the wheelchair during operation and simultaneously enable a user to lock the wheelchair to a mating device.

Figure 1:
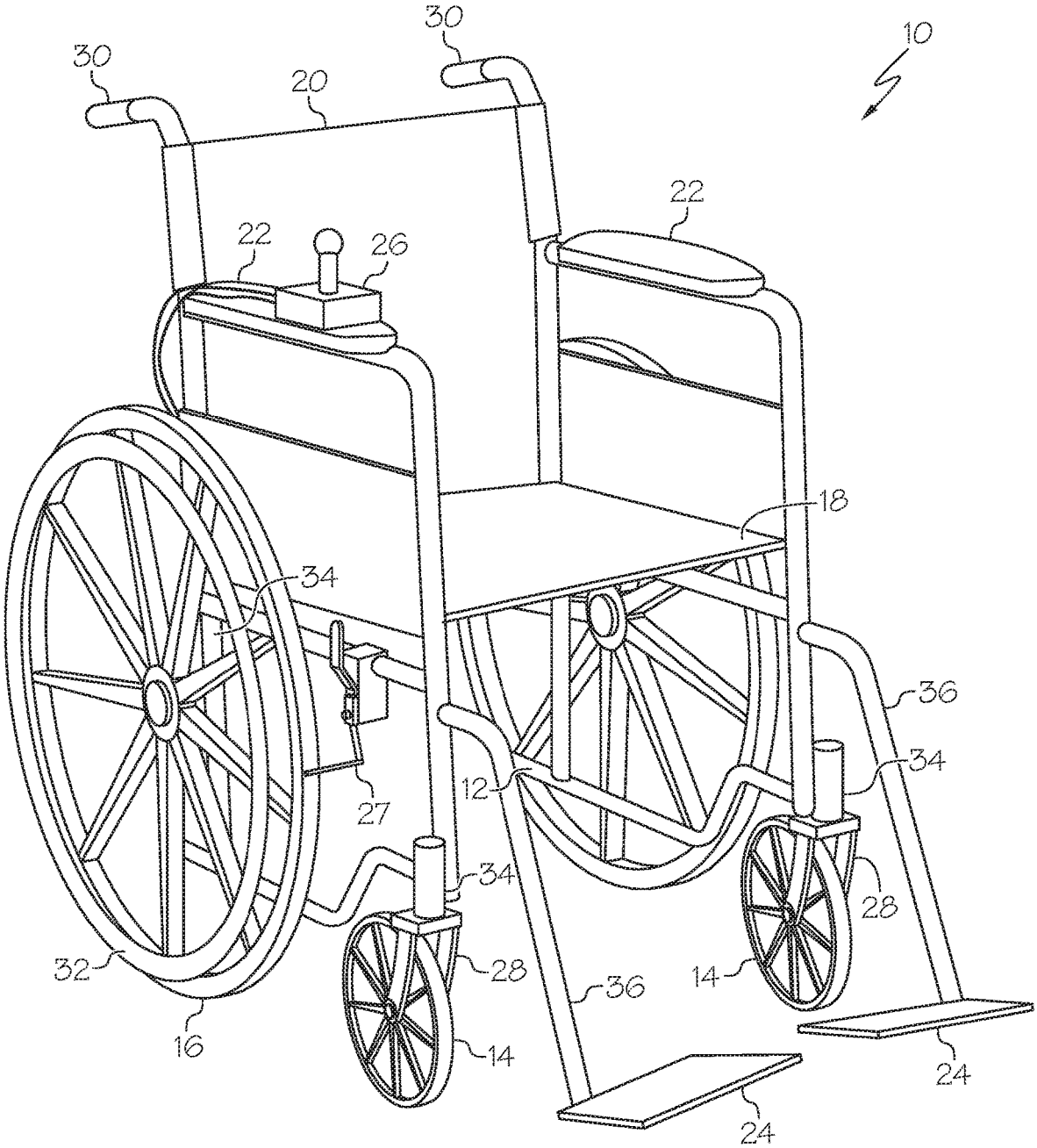
FIG. 1 schematically depicts a perspective view of an example wheelchair according to one or more embodiments shown and described herein.

Referring now to FIG. 1, a perspective view of an example wheelchair 10 is schematically depicted. In some embodiments, the wheelchair includes a frame 12, front wheels 14, rear wheels 16, a seat portion 18, a back portion 20, arm portions 22, foot portions 24, a control device 26, and a brake 27. While the illustrated embodiment depicts a manual wheelchair, it should be understood that the wheelchair 10 may any type of wheelchair, such as a powered wheelchair (e.g., an electric wheelchair), pediatric wheelchair, stroller, positional wheelchair, sports wheelchair, handcycle, mobility scooter, standing wheelchair, beach wheelchair, etc.

In some embodiments, the front wheels 14 may be rotatably mounted to the frame 12 via caster housings 28. Furthermore, the caster housings 28 may be rotatably mounted to the frame 12 using a respective kingpin 34. In some embodiments, in response to the wheelchair 10 receiving a force (e.g., a user applying a force using at least one of the handles 30 or the user rotating rear wheels 16 using rims 32), the front wheels 14 are configured to rotate and roll about a respective kingpin 34, and the rear wheels 16 are also configured to roll about a respective kingpin 34. In various embodiments, the wheelchair 10 may stop or reduce the rolling of the front wheels 14 and the rear wheels 16 in response to the brake 27 being activated.

In some embodiments, the seat portion 18 may be fixedly mounted to the frame 12. The seat portion 18 may be mounted to the frame 12 using any suitable linkages, fastening elements, and/or fastening devices. As a non-limiting example, the seat portion 18 provides a user of the wheelchair 10 a location in which he or she can sit. In some embodiments, the seat portion 18 may include a strap for securing a user to the seat portion 18 of the wheelchair 10.

In various embodiments, the back portion 20 is fixedly mounted to the frame 12, and the back portion 20 may be perpendicular to the seat portion 18. As a non-limiting example, the back portion 20 provides structural support and additional comfort to a user's back while he or she is seated in the wheelchair 10. The back portion 20 may be mounted to the frame 12 using any suitable linkages, fastening elements, and/or fastening devices. In some embodiments, the back portion 20 may include a strap for securing a user to the back portion 20 of the wheelchair 10.

In some embodiments, the arm portions 22 extend outwardly from the back portion 20, and the arm portions 22 may be fixedly mounted to the frame 12. As a non-limiting example, the arm portions 22 provide structural support and additional comfort to a user's arms while seated in the wheelchair 10. The arm portions 22 may be mounted to the frame 12 and/or the back portion 20 using any suitable linkages, fastening elements, and/or fastening devices.

In various embodiments, the foot portions 24 may be coupled to the frame 12 via connector elements 36. As a non-limiting example, the arm portions 22 provides structural support and additional comfort to a user's legs and/or feet while seated in the wheelchair 10. In some embodiments, the foot portions 24 may include a strap for fixing a foot of the user to the wheelchair 10.

As depicted in the illustrated embodiment, the wheelchair 10 includes the control device 26. As a non-limiting example, the control device 26 is fixedly mounted to one of the arm portions 22. It should be understood that in other embodiments, the control device 26 may be fixedly mounted to any other location of the wheelchair 10. As described below in further detail, the control device 26 is configured to set a locking system to one of an extended operation state and a retracted operation state. Accordingly, in some embodiments, the control device 26 may include an input element (e.g., a switch, lever, button, knob, dial, etc.) or a display configured to receive an input via an interaction with a graphical user interface (GUI) element (e.g., a button) disposed on the display. As such, in response to receiving the input, the control device 26 is configured to set the locking system to one of an extended operation state and a retracted operation state.

In order to execute the functionality described herein, the control device 26 may include at least one of an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes machine-readable instructions; a memory circuit (shared, dedicated, or group) that stores machine-readable instructions executed by the processor circuit; other suitable hardware components that provide the described functionality; or a combination of some or all of the above, such as in a system-on-chip.

Figure 2A:
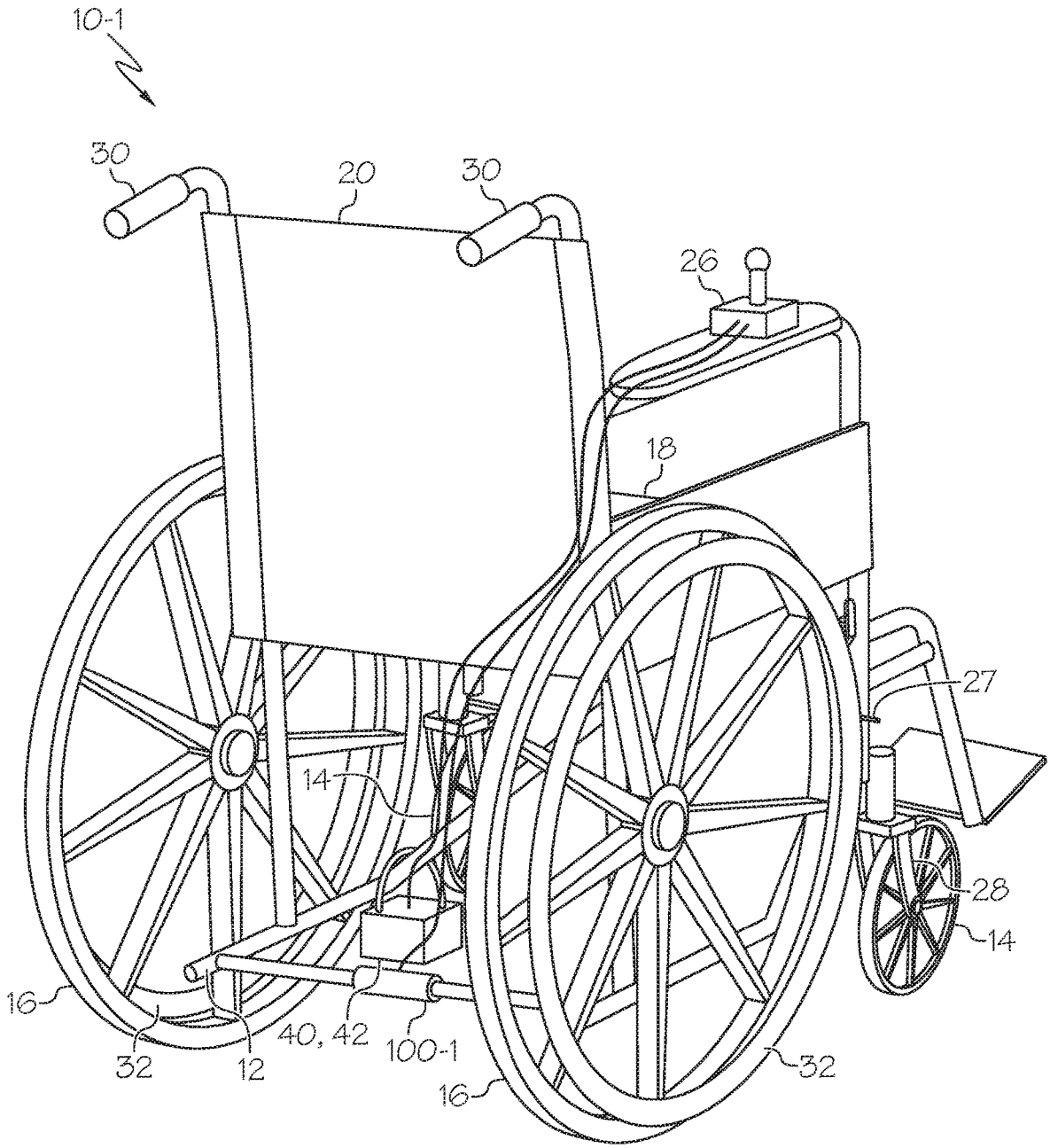
FIG. 2A schematically depicts a perspective view of an example wheelchair including a hydraulic reservoir and hydraulic pump according to one or more embodiments shown and described herein.

Referring now to FIG. 2A, a perspective view of an example wheelchair 10-1 is schematically depicted. Wheelchair 10-1 is similar to wheelchair 10 described above with reference to FIG. 1, but in this illustrated embodiment, wheelchair 10-1 includes a hydraulic reservoir 40, a hydraulic pump 42, and a locking system 100-1.

In some embodiments, the hydraulic reservoir 40 may be a container, tank, or other similar device containing a fluid that is provided to a hydraulic actuator (shown below). As a non-limiting example, the hydraulic reservoir 40 may contain water, oil, or other suitable fluids for activating a hydraulic actuator. A user may activate the hydraulic actuator by, for example, interacting with the control device 26 to cause the hydraulic pump 42 to create a vacuum, thereby forcing some of the fluid from the hydraulic reservoir 40 into the hydraulic actuator.

In the illustrated embodiment, the locking system 100-1 is mounted to the frame 12 and underneath the seat portion 18 of the wheelchair 10-1. Furthermore, the locking system 100 may be mounted between the rear wheels 16. It should be understood that in other embodiments, the locking system 100-1 may be mounted at any location of the wheelchair 10.

As described below in further detail with reference to FIGS. 2B-2D, the locking system 100-1 is operable in one of an extended operation state and a retracted operation state. During the extended operation state, a locking member (shown below in FIGS. 2B-2D) is configured to engage with a mating device located beneath the wheelchair 10-1 in order to securely retain and lock the position of the wheelchair 10-1. During the retracted operation state, the locking member does not engage with the mating device, thereby enabling the wheelchair 10-1 to move when a force is applied using at least one of the handles 30 or to the rear wheels 16 via rims 32.

Figure 2B:
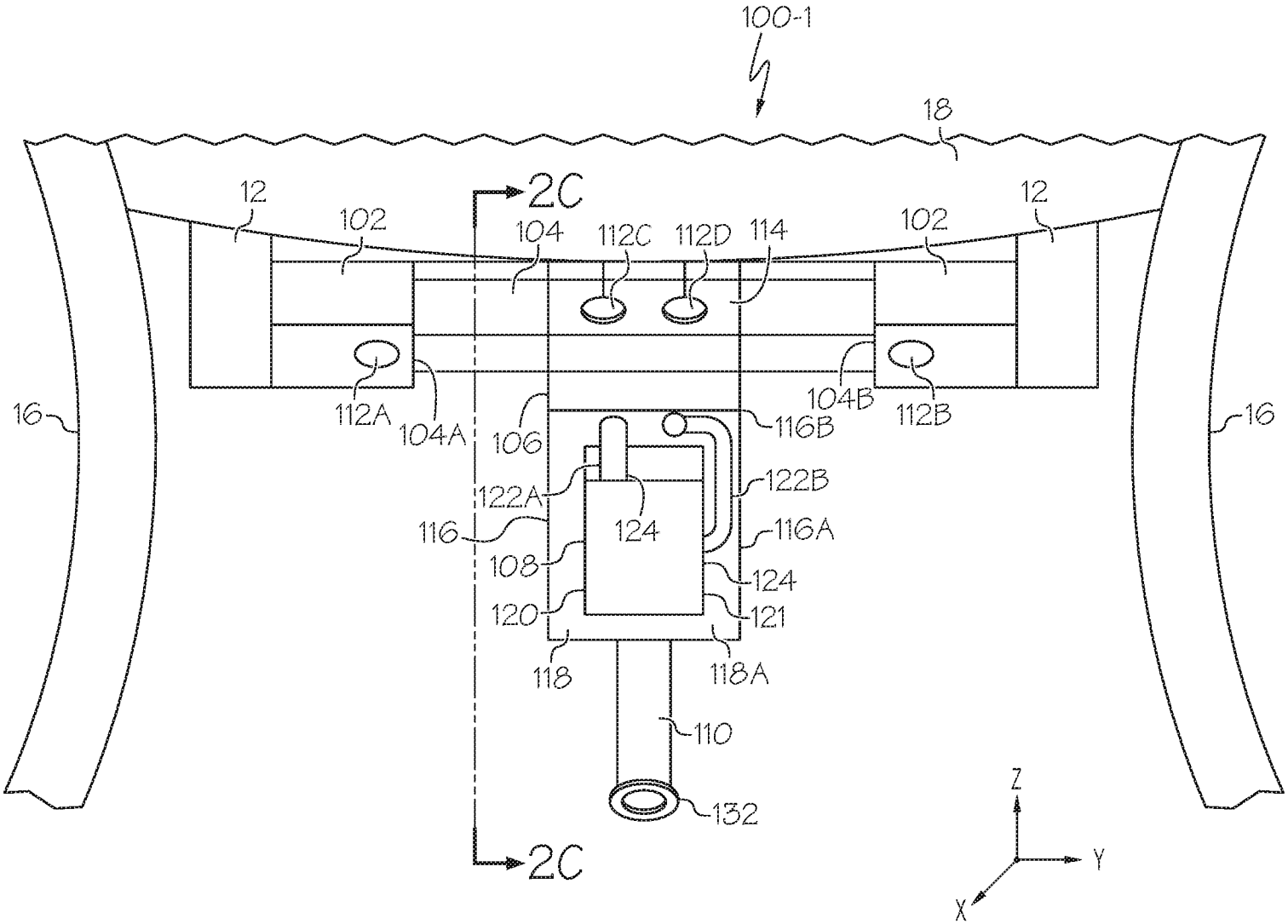
FIG. 2B schematically depicts a perspective view of an example locking system including a hydraulic actuator according to one or more embodiments shown and described herein.
Figure 2C:
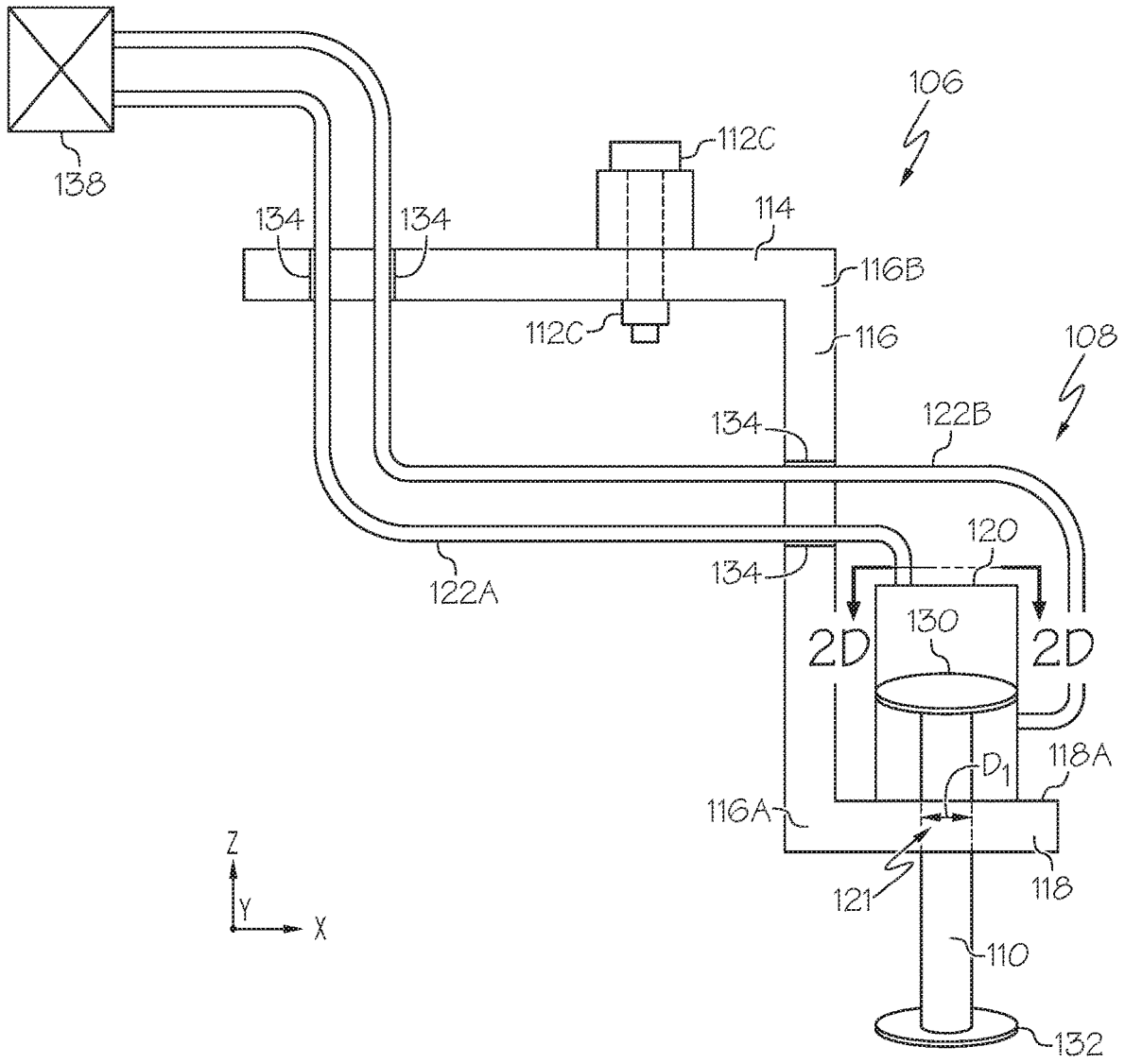
FIG. 2C schematically depicts a side view of an example locking system according to one or more embodiments shown and described herein.

With reference to FIGS. 2B-2C, a perspective view and side view of the locking system 100-1, respectively, are schematically depicted. In the illustrated embodiment, the locking system 100-1 includes coupling sleeves 102, a coupling member 104, a locking frame 106, a hydraulic actuator 108, and a locking member 110 (e.g., a pin).

In some embodiments, the coupling sleeves 102 are fixedly mounted or integrally coupled to the frame 12. Furthermore, in the illustrated embodiment, the coupling sleeves 102 are configured to receive each end 104A, 104B of the coupling member 104, and the coupling member 104 may be securely retained within the coupling sleeves 102 using fastening elements 112A, 112B (e.g., screws, rivets, bolts and nuts, etc.). As a non-limiting example, the coupling sleeves 102 and the coupling member 104 may include metal, a metal alloy, carbon fiber, plastic, or other suitable materials for mechanically coupling the coupling sleeves 102 and the coupling member 104 to the frame 12.

In some embodiments, the locking frame 106 comprises a horizontal portion 114, a vertical portion 116, and a flange portion 118. The flange portion 118 may be integrally coupled to the vertical portion 116 at a first end 116A of the vertical portion 116, and the horizontal portion 114 may be integrally coupled to the vertical portion 116 at a second end 116B of the vertical portion 116. Furthermore, the horizontal portion 114 of the locking frame 106 may be coupled to the coupling member 104 via fastening elements 112C, 112D (e.g., screws, rivets, bolts and nuts, etc.).

The hydraulic actuator 108, which may be disposed on at least one of the flange portion 118 and the vertical portion 116 of the locking frame 106, may include a housing 120 and fluid paths 122A, 122B (collectively referred to as fluid paths 122) partially disposed within fluid path openings 124 of the housing 120. The fluid paths 122 may be in communication with the hydraulic reservoir 40 and the hydraulic pump 42, and the fluid paths 122 may include any material that enables fluid from the hydraulic reservoir 40 to flow into the hydraulic actuator 108. In an example embodiment, when the user activates the hydraulic actuator 108 by interacting with the control device 26, as described above, fluid from the hydraulic reservoir 40 is provided within the housing 120 of the hydraulic actuator 108 via one of the fluid paths 122. Furthermore, by selectively designating one of the fluid paths 122 to deliver the fluid from the hydraulic reservoir 40 and the hydraulic pump 42, a user can set the operation of the locking system 100-1 to one of the extended operation state and the retracted operation state, as described below in further detail.

In the illustrated embodiment, the vertical portion 116 of the locking frame 106 may be perpendicular to at least one of the horizontal portion 114 and the flange portion 118. Furthermore, a portion of the fluid paths 122 may be partially disposed within openings 134 of the horizontal portion 114.

In some embodiments, the flange portion 118 of the locking frame 106 may include an opening 121. The opening 121 may be positioned on the flange portion 118 such that the housing 120 of the hydraulic actuator 108 entirely covers the opening 121 with respect to an upper surface 118A of the flange portion 118. In various embodiments, the opening 121 may have a geometry and/or dimensions that accommodate the geometry and/or dimensions of the locking member 110. As a non-limiting example, the opening 121 may be circular and may have a first diameter ($D_1$), wherein the first diameter ($D_1$) is a value that enables the locking member 110 to move in an upward and downward direction (±Z) within the opening 121 (e.g., the first diameter and a diameter of the locking member 110 are approximately equal). Moreover, the first diameter ($D_1$) may be a value that is less than a width of a stop portion of the locking member 110 (shown below in FIG. 2D). Accordingly, the locking member 110 is unable to move beyond the opening 121 in a downward direction (−Z), thereby preventing the locking member 110 from disengaging with the hydraulic actuator 108, as described below in further detail with reference to FIG. 2D.

The locking member 110 may also include a mating portion 132. In some embodiments, the mating portion 132 is configured to engage with a mating device (shown below) when the locking system 100-1 is in the extended operation state, thereby securely retaining and locking the position of the wheelchair 10-1 with respect to the mating device. As a non-limiting example, the mating portion 132 may be a nut that is integrally coupled to the locking member 110 or that is threadably coupled to the locking member 110.

Figure 2D:
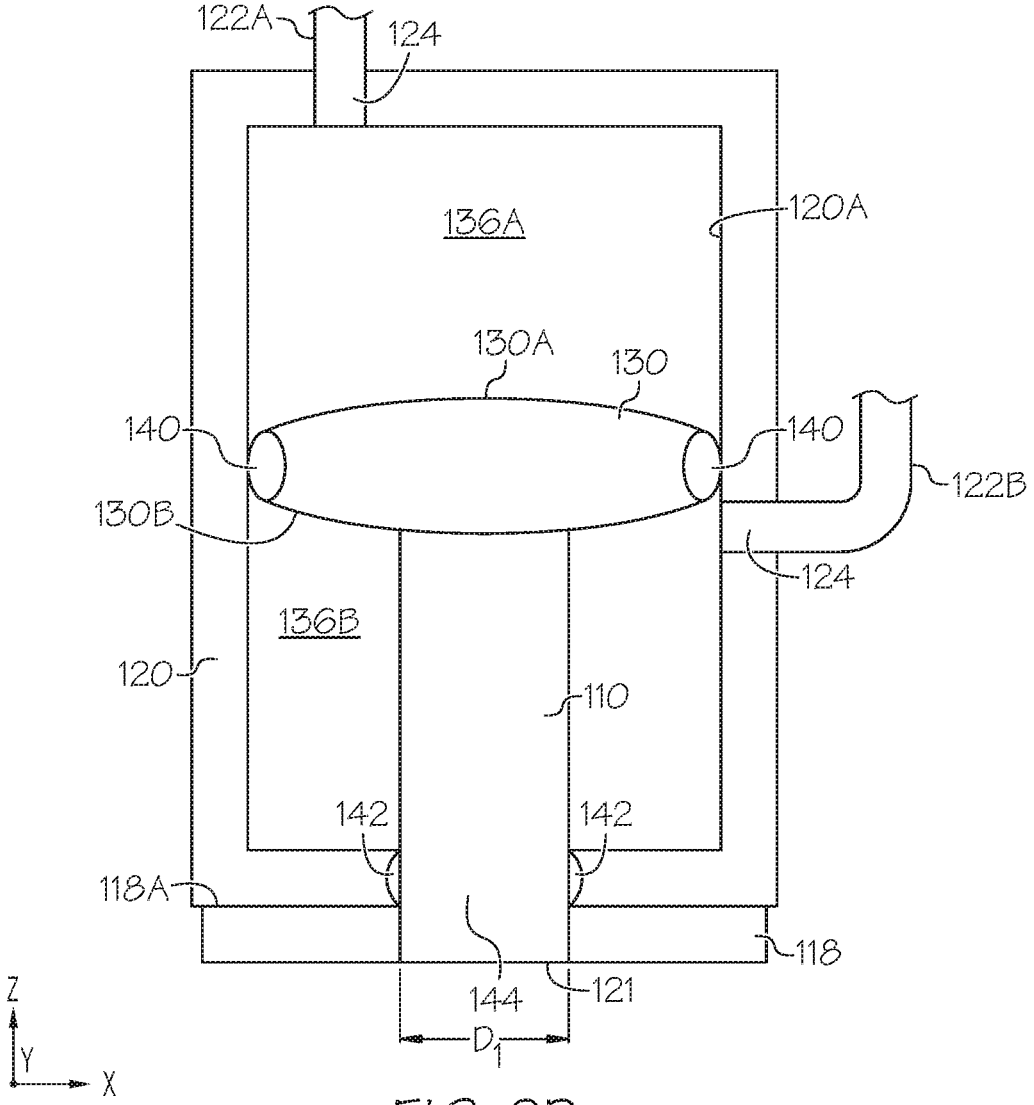
FIG. 2D schematically depicts a cross section view of an example hydraulic actuator according to one or more embodiments shown and described herein.

With reference to FIG. 2D, a cross section view of the hydraulic actuator 108 is schematically depicted. In various embodiments, the locking member 110 may include a stop portion 130 that is located at an opposite end of the mating portion 132. As described above, the stop portion 130 may have a width that is greater than the first diameter ($D_1$) of the opening 121 and that is greater than an opening 144 of the housing 120, thereby preventing the locking member 110 from extending from the locking frame 106 in the downward direction beyond a threshold distance. Furthermore, the stop portion 130 may have a width that enables the locking member 110 to move in an upward and downward direction (±Z) within the opening 121 and the opening 144 of the housing 120 when the user sets the locking system 100-1 to one of the retracted and extended operation states.

In some embodiments, a first chamber 136A and a second chamber 136B (collectively referred to as chambers 136) may be included within the housing 120. The chambers 136 may be physically separated by the stop portion 130 and by seals 140, which are described below in further detail. Moreover, the first fluid path 122A may be configured to guide fluid into the first chamber 136A, and the second fluid path 122B may be configured to guide fluid into the second chamber 136B.

In an example embodiment, a user may interact with the control device 26 to cause the hydraulic pump 42 to create a vacuum in the first fluid path 122A, thereby forcing some of the fluid from the hydraulic reservoir 40 into the first chamber 136A. As a non-limiting example, by forcing the fluid into the first chamber 136A, the force of the fluid is applied to an upper surface 130A of the stop portion 130, thereby causing the locking member 110 to move in a downward direction (−Z) through the opening 121 (i.e., the extended operation state of the locking system 100-1). Furthermore, by causing the locking member 110 to move in the downward direction (−Z) through the opening 121, fluid that is located in the second chamber 136B may be expelled from the second chamber 136B and provided to the hydraulic reservoir 40 via the second fluid path 122B.

In another example embodiment, by forcing the fluid into the second chamber 136B, the force of the fluid is applied to a lower surface 130B of the stop portion 130, thereby forcing the locking member 110 to move in an upward direction (+Z) through the opening 121 (i.e., the retracted operation state of the locking system 100-1). Furthermore, by causing the locking member 110 to move in the upward direction (+Z) through the opening 121, fluid that is located in the first chamber 136A may be expelled and provided to the hydraulic reservoir 40 via the first fluid path 122A.

In the illustrated embodiment, a fluid path valve 138 is configured to designate which fluid path 122 receives the fluid pumped by the hydraulic pump 42. As a non-limiting example, the control device 26 may be communicatively coupled to the fluid path valve 138. In response to an interaction with the control device 26 indicating that the user desires to set the locking system 100-1 to one of the retracted or extended operation states, the fluid path valve 138 receives a control signal from the control device 26. The control signal may cause the fluid path valve 138 to couple the corresponding fluid path 122 to the hydraulic pump 42.

In some embodiments, the locking member 110 may be naturally biased in the extended operation state. As a non-limiting example, when at least one of the fluid paths 122 disconnects the hydraulic reservoir 40 and the hydraulic actuator 108 or when an amount of fluid within the hydraulic actuator 108 is below a threshold amount, the locking member 110 may move in the downward direction (−Z) and be in the extended operation state.

While the embodiments described above illustrate a double acting hydraulic actuator 108, in other embodiments, the hydraulic actuator 108 may be a single acting hydraulic actuator. Accordingly, the fluid path valve 138 may be removed, and one of the fluid paths 122 (e.g., first fluid path 122A) may be coupled to the other fluid path (e.g., the second fluid path 122B) and the hydraulic reservoir 40. As such, a release valve (not shown) may be included to set the locking system 100-1 to one of the retracted or extended operation states.

As schematically illustrated in FIG. 2D, seals 140 may be disposed between an inner surface 120A of the housing 120 and the stop portion 130. The seals 140 are configured to provide a physical barrier between the first chamber 136A and the second chamber 136B, thereby isolating the fluids in each of the first chamber 136A and the second chamber 136B. As a non-limiting example, the seals 140 may include various materials configured to seal the fluid, such as nitrile rubber, fluoroelastomer, and/or ethylene propylene diene.

In various embodiments, seals 142 may be disposed between on each edge of an opening 144 of the housing 120. The seals 142 are also configured to prevent fluids from escaping the second chamber 136B and the housing 120. As a non-limiting example, the seals 140 may include various materials configured to seal the fluid, such as nitrile rubber, fluoroelastomer, and/or ethylene propylene diene.

While the embodiments described above with reference to FIGS. 2A-2D illustrate the hydraulic actuator 108, the hydraulic reservoir 40, and the hydraulic pump 42, in other embodiments, different types of actuators may be included within the locking system 100-1. As a non-limiting example and as described below in further detail with reference to FIGS. 3A-3D, the locking system may include a pneumatic actuator, pneumatic reservoir, and pneumatic pump.

Figure 3A:
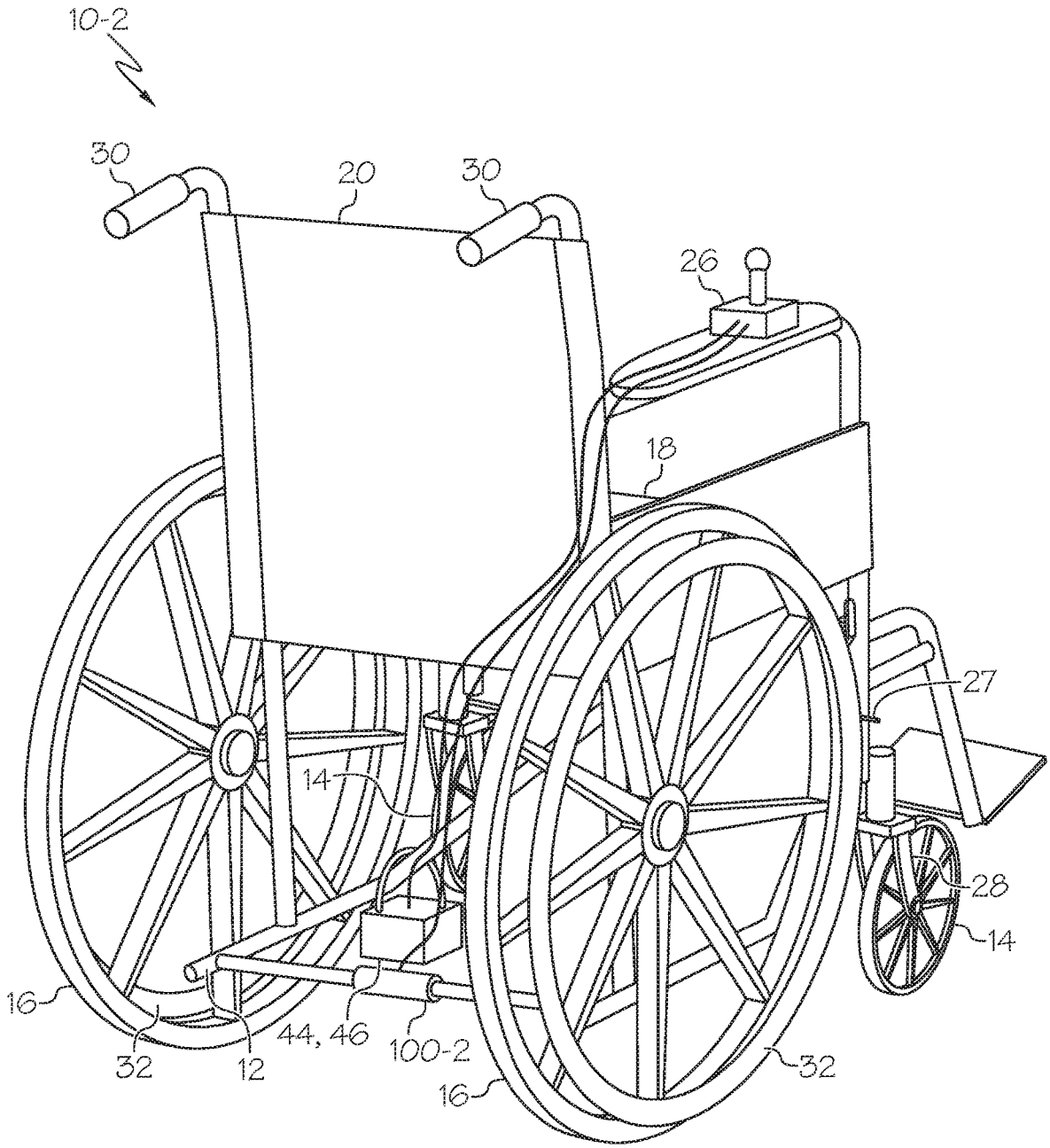
FIG. 3A schematically depicts a perspective view of an example wheelchair including a pneumatic reservoir and pneumatic pump according to one or more embodiments shown and described herein.

Referring now to FIG. 3A, a perspective view of an example wheelchair 10-2 is schematically depicted. Wheelchair 10-2 is similar to wheelchair 10-1 described above with reference to FIGS. 2A-2D, but in this illustrated embodiment, wheelchair 10-2 includes a pneumatic reservoir 44, a pneumatic pump 46, and locking system 100-2.

In some embodiments, the pneumatic reservoir 44 may be a container, tank, or other similar device containing a gas that is provided to a pneumatic actuator (shown below). As a non-limiting example, the pneumatic reservoir 44 may contain compressed air or other suitable gases for activating a pneumatic actuator. A user may activate the pneumatic actuator by, for example, interacting with the control device 26 to cause the pneumatic pump 46 to create a vacuum, thereby forcing some of the gas from the pneumatic reservoir 44 into the pneumatic actuator.

In the illustrated embodiment, the locking system 100-2 is mounted to the frame 12 and underneath the seat portion 18 of the wheelchair 10-2. Furthermore, the locking system 100-2 may be mounted between the rear wheels 16. It should be understood that in other embodiments, the locking system 100-2 may be mounted at any location of the wheelchair 10.

Similar to locking system 100-1 described above with reference to FIGS. 2A-2D, the locking system 100-2 is operable in one of the extended operation state and the retracted operation state. During the extended operation state, the locking member 110 (shown below in FIGS. 3B-3D) is configured to engage with a mating device located beneath the wheelchair 10-2 to securely retain and lock the position of the wheelchair 10-2. During the retracted operation state, the locking member 110 does not engage with the mating device, thereby enabling the wheelchair 10-2 to move when force is applied using at least one of the handles 30 or the rear wheels 16 via the rims 32.

Figure 3B:
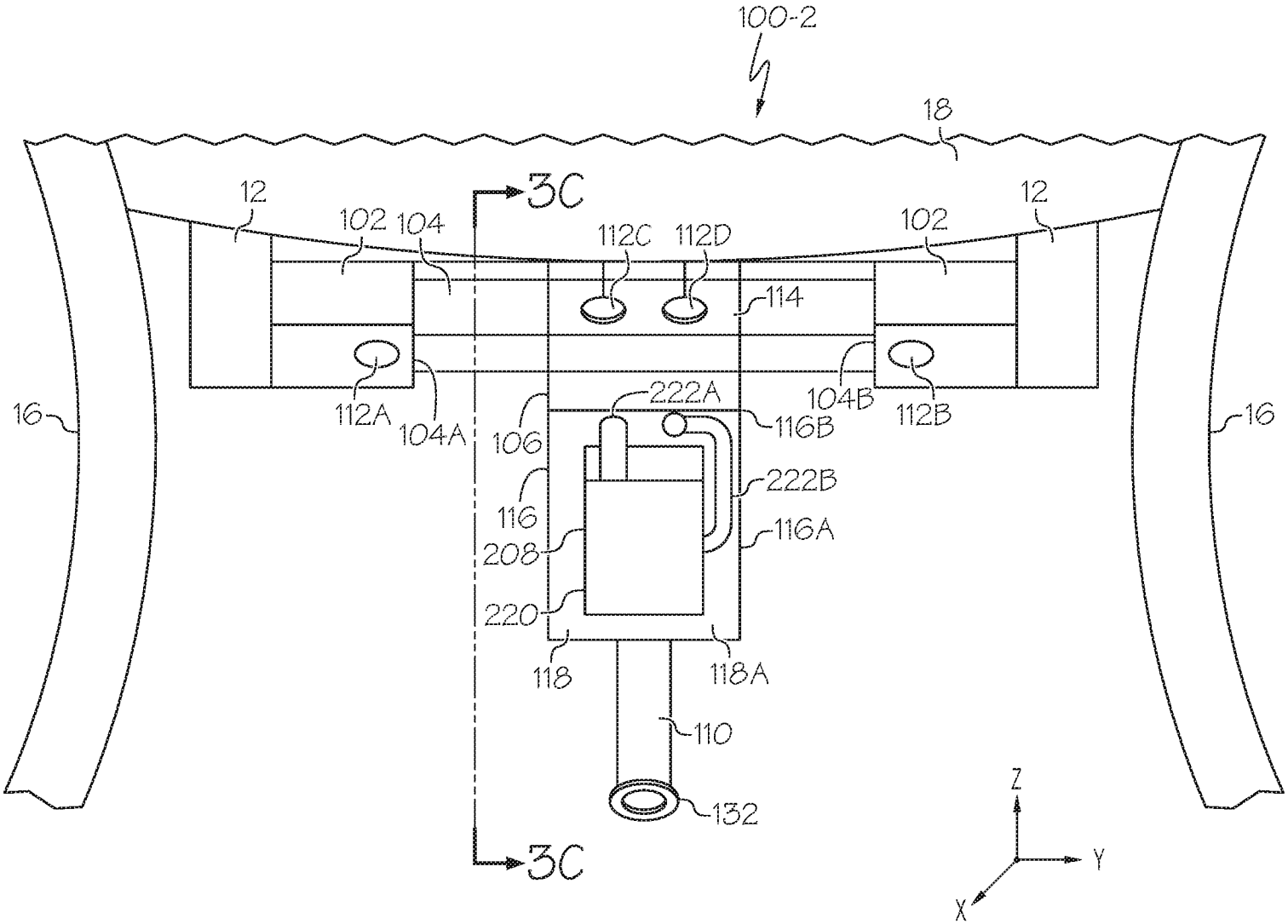
FIG. 3B schematically depicts a perspective view of an example locking system including a pneumatic actuator according to one or more embodiments shown and described herein.
Figure 3C:
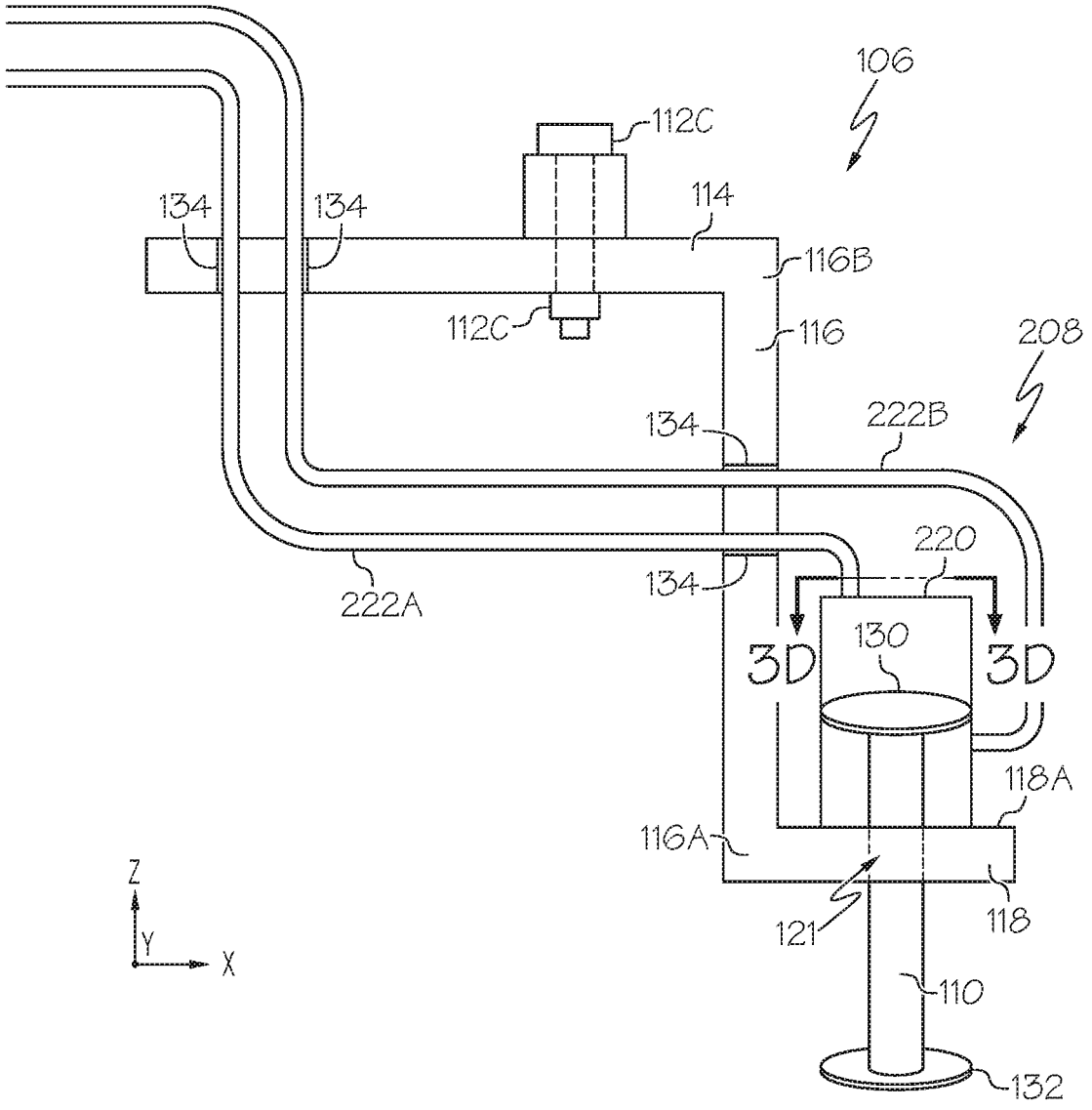
FIG. 3C schematically depicts a side view of another example locking system according to one or more embodiments shown and described herein.

With reference to FIGS. 3B-3C, a perspective view and side view of the locking system 100-2, respectively, are schematically depicted. Similar to locking system 100-1 described above with reference to FIGS. 2A-2D, the locking system 100-2 includes the coupling sleeves 102, the coupling member 104, the locking frame 106, and the locking member 110.

In the illustrated embodiment, a pneumatic actuator 208, which is disposed on at least one of the flange portion 118 and the vertical portion 116 of the locking frame 106, may include a housing 220 and gas paths 222A, 222B (collectively referred to as gas paths 222) partially disposed within gas path openings 224 of the housing 220. The gas paths 222 may be in communication with the pneumatic reservoir 44 and the pneumatic pump 46, and the gas paths 222 may include any material that enables gas from the pneumatic reservoir 44 to flow into the pneumatic actuator 208. Furthermore, a portion of the gas paths 222 may be partially disposed within openings 134 of the horizontal portion 114.

In an example embodiment, when the user activates the pneumatic actuator 208 by interacting with the control device 26 to cause the pneumatic pump 46 to create a vacuum, as described above, fluid from the pneumatic reservoir 44 is provided within the housing 220 of the pneumatic actuator 208 via one of the gas paths 222. Furthermore, by selectively designating one of the gas paths 222 to deliver the gas from the pneumatic reservoir 44 and the pneumatic pump 46, a user can set the operation of the locking system 100-2 to one of the extended operation state and the retracted operation state, as described below in further detail.

Figure 3D:
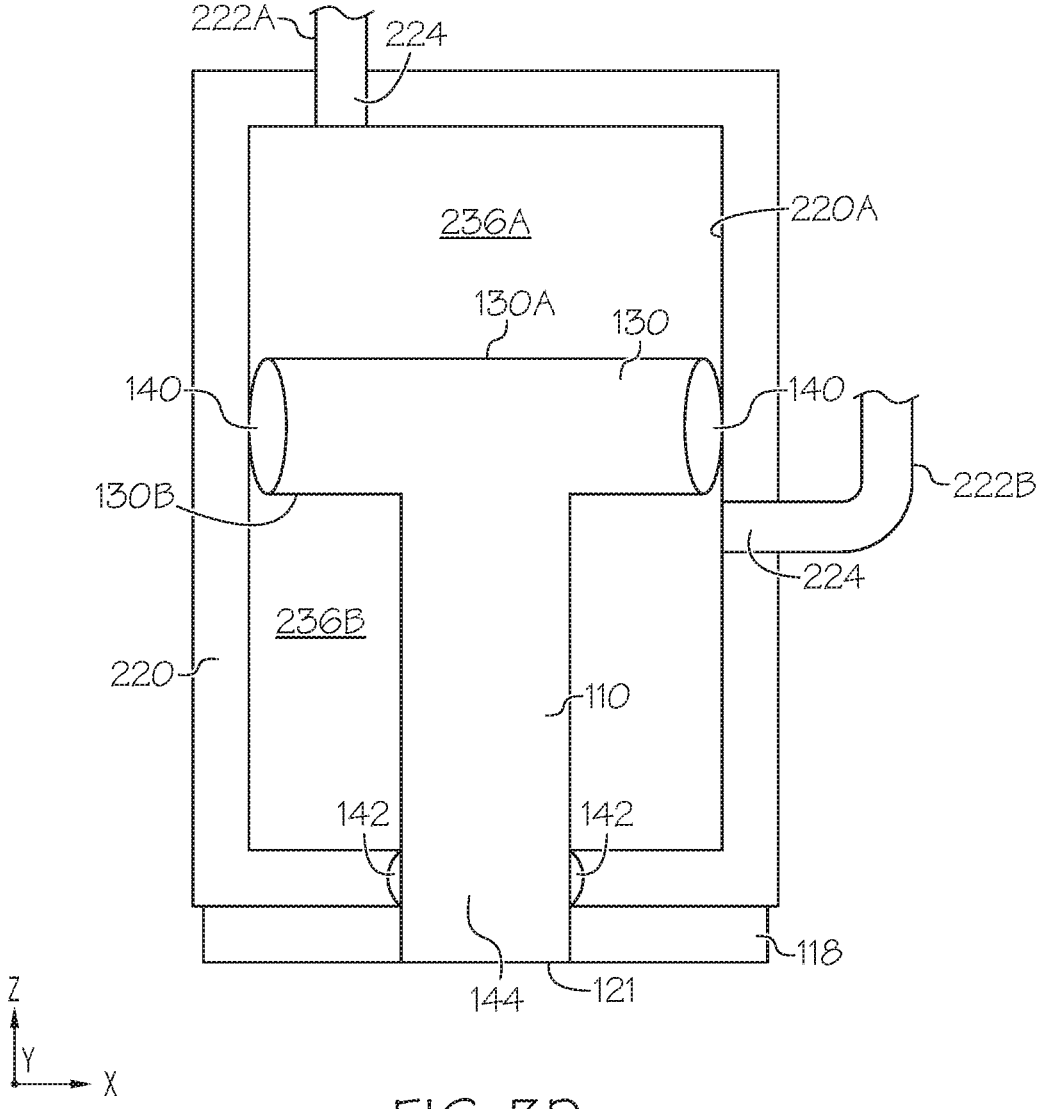
FIG. 3D schematically depicts a cross section view of an example pneumatic actuator according to one or more embodiments shown and described herein.

With reference to FIG. 3D, a cross section view of the pneumatic actuator 208 is schematically depicted. In some embodiments, a first chamber 236A and a second chamber 236B (collectively referred to as chambers 236) may be included within the housing 220. The chambers 236 may be physically separated by the stop portion 130 of the locking member 110 and the seals 140. Moreover, the first gas path 222A may be configured to guide gas into the first chamber 236A, and the second gas path 222B may be configured to guide gas into the second chamber 236B.

In an example embodiment, a user may interact with the control device 26 to cause the pneumatic pump 46 to force some of the gas from the pneumatic reservoir 44 into the first chamber 236A. As a non-limiting example, by forcing the gas into the first chamber 236A, the force of the gas is applied to the upper surface 130A of the stop portion 130, thereby causing the locking member 110 to move in a downward direction (−Z) through the opening 121 (i.e., the extended operation state of the locking system 100-2). Furthermore, by causing the locking member 110 to move in the downward direction (−Z) through the opening 121, gas that is located in the second chamber 236B may be expelled from the second chamber 236B and provided to the pneumatic reservoir 44 via the second gas path 222B.

In another example embodiment, by forcing the gas into the second chamber 236B, the force of the gas is applied to a lower surface 130B of the stop portion 130, thereby forcing the locking member 110 to move in an upward direction (+Z) through the opening 121 (i.e., the retracted operation state of the locking system 100-2). Furthermore, by causing the locking member 110 to move in the upward direction (+Z) through the opening 121, gas that is located in the first chamber 236A may be expelled and provided to the pneumatic reservoir 44 via the first gas path 222A.

In the illustrated embodiment, a gas path valve 238 is configured to designate which gas path 222 receives the gas pumped by the pneumatic pump 46. As a non-limiting example, the control device 26 may be communicatively coupled to the gas path valve 238. In response to an interaction with the control device 26 indicating that the user desires to set the locking system 100-2 to one of the retracted or extended operation states, the gas path valve 238 receives a control signal from the control device 26. The control signal may cause the gas path valve 238 to couple the corresponding gas path 222 to the pneumatic pump 46.

In some embodiments, the locking member 110 may be naturally biased in the extended operation state. As a non-limiting example, when at least one of the gas paths 222 disconnects the pneumatic reservoir 44 and the pneumatic actuator 208 or when an amount of gas within the pneumatic actuator 208 is below a threshold amount, the locking member 110 may move in the downward direction (−Z) and be in the extended operation state.

While the embodiments described above illustrate a double acting pneumatic actuator 208, in other embodiments, the pneumatic actuator 208 may be a single acting pneumatic actuator. Accordingly, the gas path valve 238 may be removed, and one of the gas paths 222 (e.g., first gas path 222A) may be coupled to the other gas path (e.g., the second gas path 222B) and the pneumatic reservoir 44. As such, a gas release valve (not shown), along with the pneumatic pump 46, may be included to set the locking system 100-2 to one of the retracted or extended operation states.

As schematically illustrated in FIG. 3D, the seals 140 may be disposed between an inner surface 120A of the housing 220 and the stop portion 130. The seals 140 are configured to provide a physical barrier between the first chamber 236A and the second chamber 236B, thereby isolating the gas in each of the first chamber 236A and the second chamber 236B. As a non-limiting example, the seals 140 may include various materials configured to seal the gas, such as nitrile rubber, fluoroelastomer, and/or ethylene propylene diene.

In various embodiments, the seals 142 may be disposed between on each edge of an opening 244 of the housing 220. The seals 142 are also configured to prevent gasses from escaping the second chamber 236B and the housing 220. As a non-limiting example, the seals 140 may include various materials configured to seal the fluid, such as nitrile rubber, fluoroelastomer, and/or ethylene propylene diene.

While the above embodiments disclose hydraulic and pneumatic actuators, it should be understood that other types of actuators may be used for setting the locking member 110 from the retracted operation state to the extended operation state. In some embodiments and as described below in further detail with reference to FIGS. 4A-4D, the actuator may be an electrical actuator.

Figure 4A:
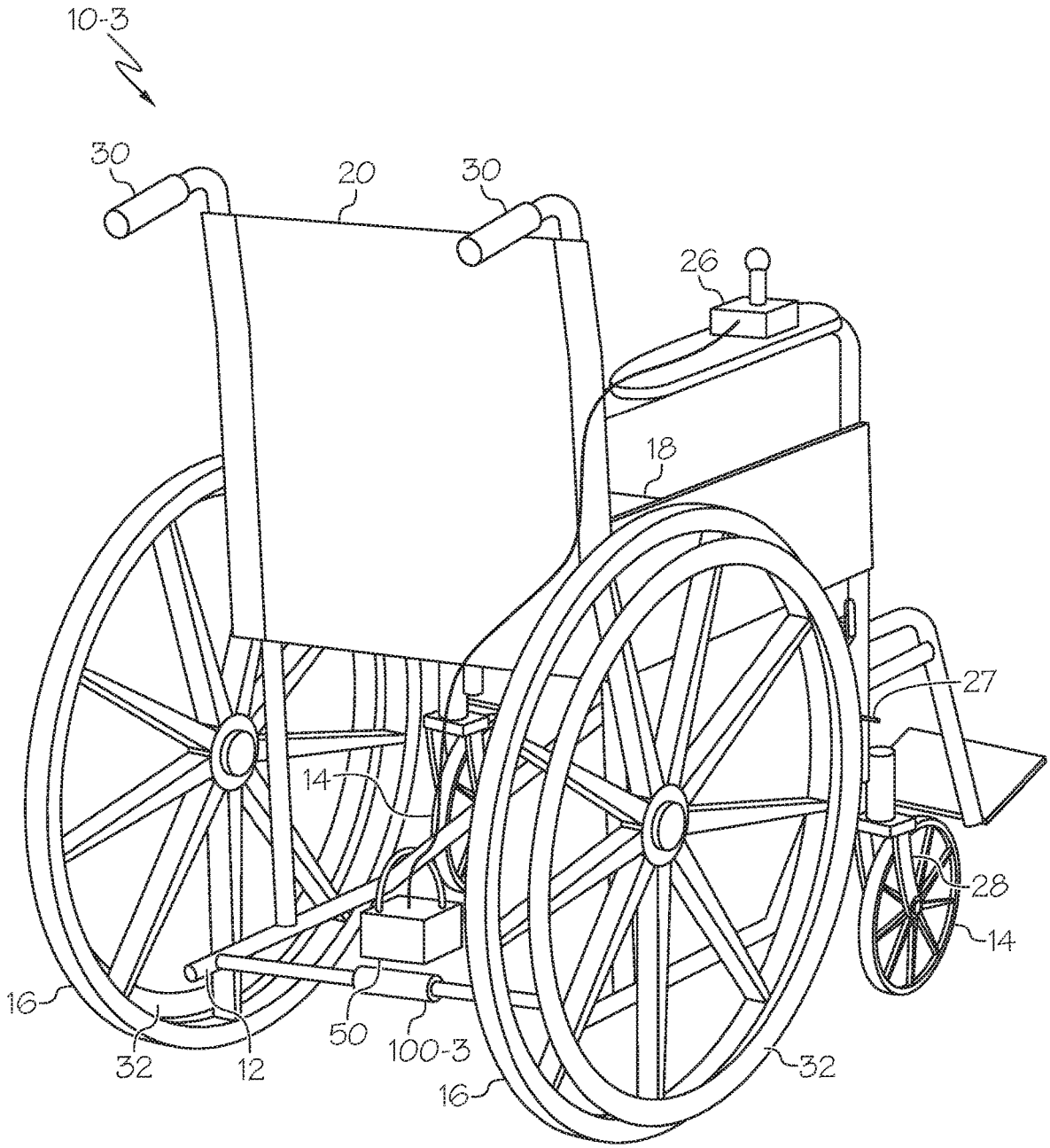
FIG. 4A schematically depicts a perspective view of an example wheelchair including an electrical power supply according to one or more embodiments shown and described herein.

Referring now to FIG. 4A, a perspective view of an example wheelchair 10-3 is schematically depicted. Wheelchair 10-3 is similar to wheelchairs 10-1, 10-2 described above with reference to FIGS. 2A-2D and 3A-3D, but in this illustrated embodiment, the wheelchair 10-3 includes an electrical power supply 50 and locking system 100-3.

In an example embodiment, the electrical power supply 50, which may be a battery, is configured to provide direct current (DC) power to the various electrical components of the electrical actuator (shown below) and/or the control device 26. In other embodiments, the electrical power supply 50 may be configured to provide alternating current (AC) power to the various electrical components of the electrical actuator. In some embodiments, the electrical power supply 50 is communicatively coupled to the electrical actuator and/or the control device 26 via a hardwire link, such as a twisted-pair cable.

In some embodiments and as described below in further detail with reference to FIGS. 4B-4D, in response to receiving a control signal from the control device 26 indicating a selection of one of the retracted operation state and the extended operation state, the electrical actuator is configured to drive a motor. Subsequently, a shaft of the motor that is physically coupled to the locking member 110 may rotate, thereby enabling the electrical actuator to set the locking system 100-3 to one of the retracted operation state and the extended operation state.

Figure 4B:
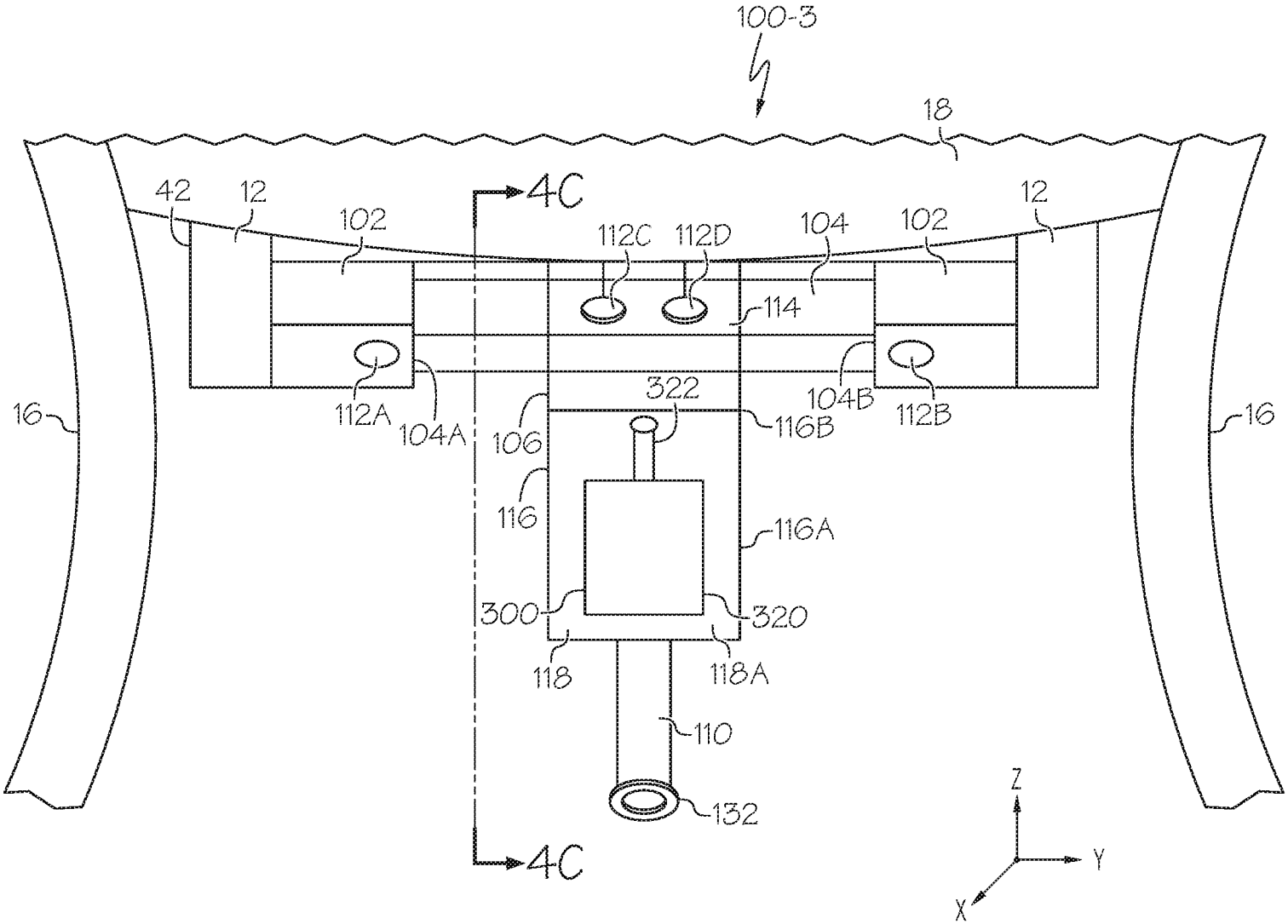
FIG. 4B schematically depicts a perspective view of an example locking system including an electrical actuator according to one or more embodiments shown and described herein.

With reference to FIGS. 4B, a perspective view of the locking system 100-3 is schematically depicted. Similar to locking systems 100-1, 100-2 described above with reference to FIGS. 2A-2D and FIGS. 3A-3D, respectively, the locking system 100-3 includes the coupling sleeves 102, the coupling member 104, the locking frame 106, and the locking member 110.

In the illustrated embodiment, the electrical actuator 308, which is disposed on at least one of the flange portion 118 and the vertical portion 116 of the locking frame 106, may include a housing 320, a conductive path 322 partially disposed within opening 324 of the housing 320, and a motor 326. In some embodiments, the conductive paths 322 may communicatively couple the electrical power supply 50 and the motor 326. As a non-limiting example, the motor 326 may be a stepper motor or servo motor.

Figure 4C:
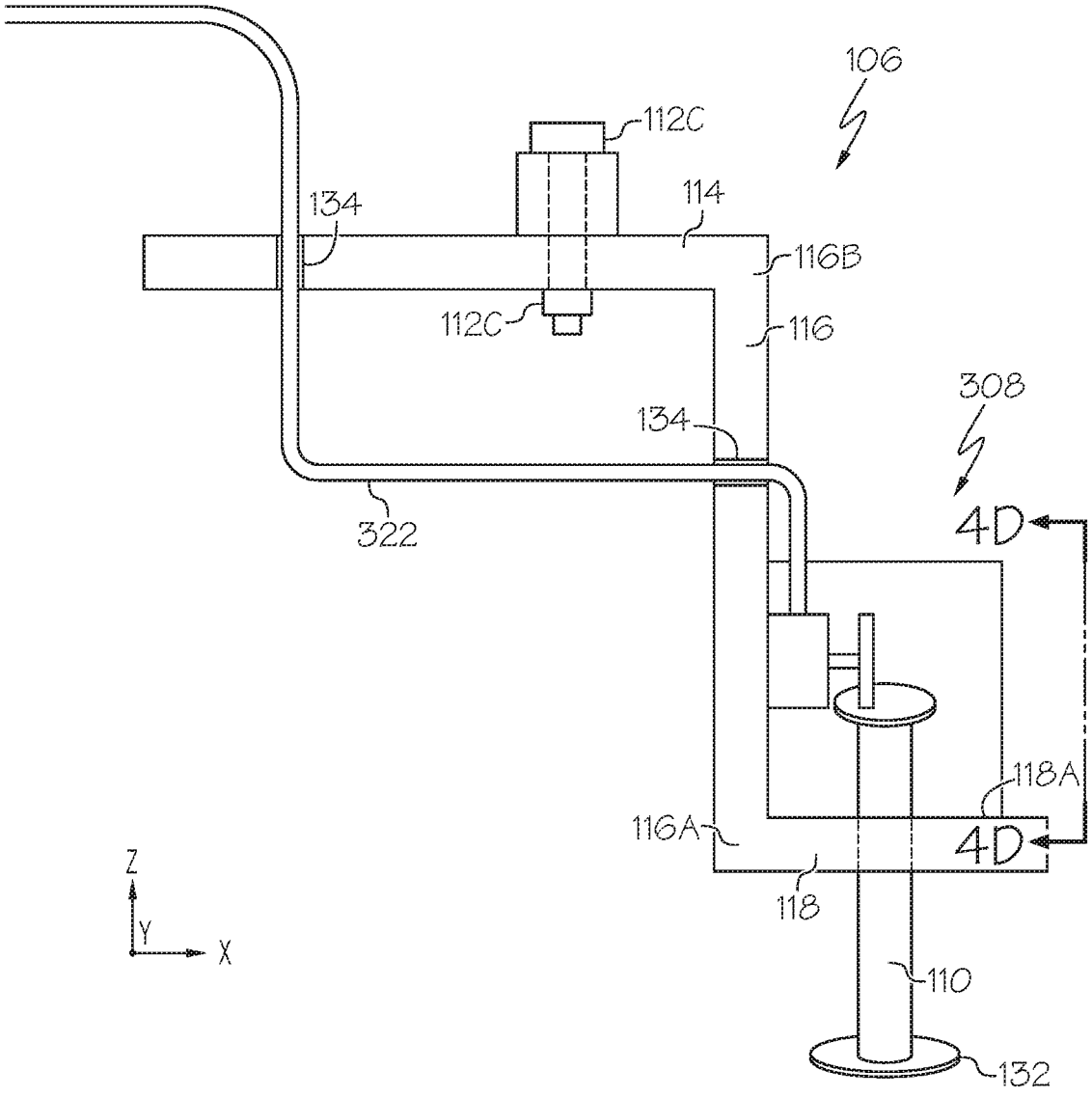
FIG. 4C schematically depicts a side view of yet another example locking system according to one or more embodiments shown and described herein.
Figure 4D:
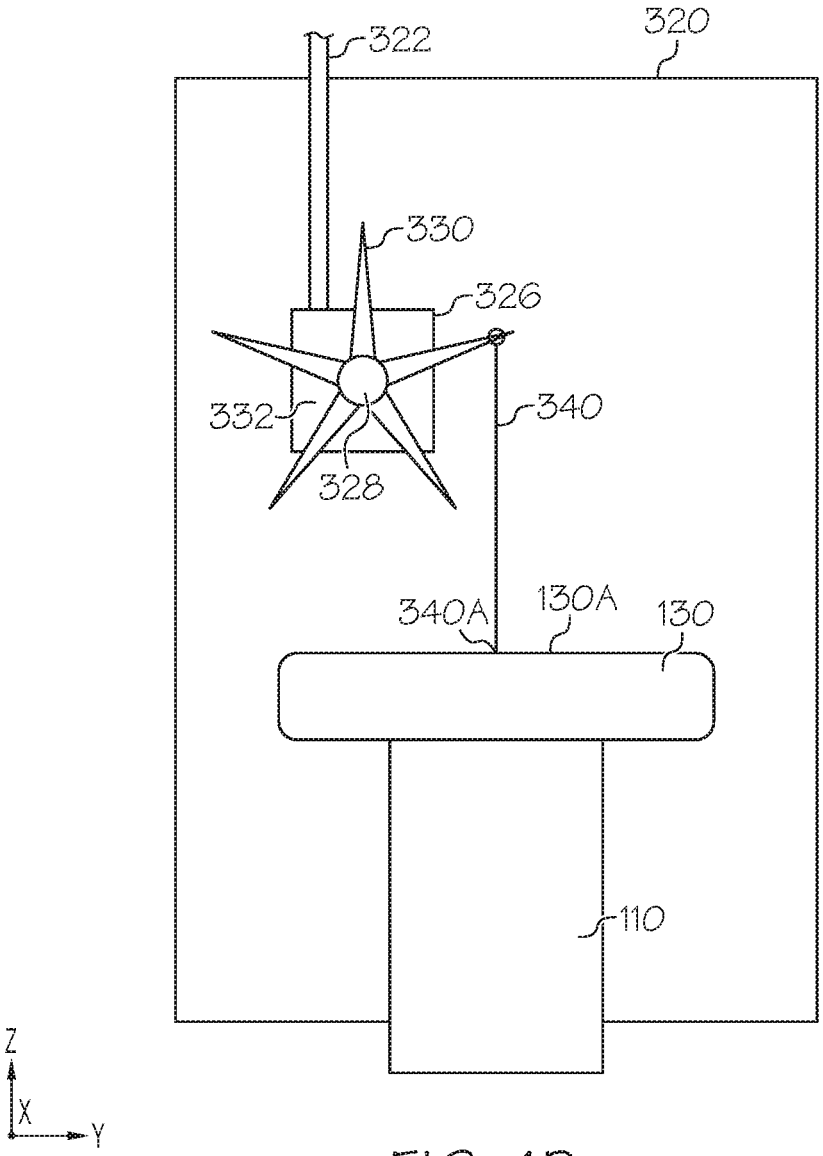
FIG. 4D schematically depicts a cross section view of an example electrical actuator according to one or more embodiments shown and described herein.

With reference to FIGS. 4C-4D, a side view of the locking system 100-3 and a cross section view of the electrical actuator 308, respectively, are schematically depicted. In some embodiments, the motor 326 includes a shaft 328 and a plurality of arms 330 extending radially from the shaft 328. In response to receiving the control signal from the control device 26, the motor 326 is configured to rotate the shaft 328 and the plurality of arms 330.

In various embodiments, the motor 326 includes a motor control circuit 332, which may including circuitry for controlling the operation and rotation of the motor 326. As a non-limiting example, if the motor 326 is a DC motor (e.g., a DC brushed motor or a DC brushless motor), the motor control circuit 332 may include an H-bridge circuit for controlling the polarity of the DC signal applied to the motor 326. Furthermore, the motor control circuit 332 may include a voltage regulator circuit and a pulse-width modulation (PWM) control circuit for controlling an amount of power delivered to the motor 326. In some embodiments, the motor control circuit 332 may include an astable multivibrator for causing the motor 326 to rotate the shaft 328 in one of the clockwise and counterclockwise directions.

In some embodiments, if the motor 326 is an AC motor, the motor control circuit 332 may include an inverter circuit for converting the DC power from the electrical power supply 50 into an AC signal having a rated voltage that is suitable for operating the motor 326. Furthermore, the motor control circuit 332 may include a variable speed control circuit, such as a triac control circuit, for controlling the speed of the motor 326.

In various embodiments, the locking system 100-3 may be set to one of the retracted operation state and the extended operation state based on the control signal provided to the motor 326. As a non-limiting example, if a control signal is applied to the motor 326 that causes it to rotate by a predetermined angular value in a first direction, the locking member 110 may be configured to move in an upward direction (+Z), thereby setting the locking system 100-3 to the retracted operation state. As another non-limiting example, if a control signal is applied to the motor 326 that causes it to rotate by a predetermined angular value in a second, opposite direction, the locking member 110 may be configured to move in a downward direction (−Z), thereby setting the locking system 100-3 to the extended operation state.

With reference to FIG. 4D, cross section view of the electrical actuator 308 is schematically depicted. In the illustrated embodiment, a first arm 330-1 of the plurality of arms 330 is coupled to the upper surface 130A of the stop portion 130 of the locking member 110 via push rod 340. In some embodiments, the push rod 340 may be configured to prevent the locking member 110 from moving in the upward or downward direction (−Z) when the motor 326 does not receive a control signal from the control device 26.

As a non-limiting example, when the motor 326 receives a control signal from the control device 26 setting the locking system 100-3 to the retracted operation state, the motor 326 may rotate in a counterclockwise direction by a predetermined angular value. Accordingly, an attachment end 340A of the push rod 340 also rotates counterclockwise, thereby moving the locking member 110 in an upward direction (+Z). As another non-limiting example, when the motor 326 receives a control signal from the control device 26 setting the locking system 100-3 to the extended operation state, the motor 326 may rotate in a clockwise direction by a predetermined angular value. Accordingly, the attachment end 340A of the push rod 340 also rotates clockwise, thereby moving the locking member 110 in a downward direction (−Z).

In some embodiments, the locking member 110 may be naturally biased in the extended operation state. As a non-limiting example, when the electrical power supply 50 and the electrical actuator 308 are disconnected, the locking member 110 may move in the downward direction (−Z) and be in the extended operation state.

While FIGS. 4A-4D illustrate the electrical actuator 308 as a linear electric actuator, it should be understood that the electrical actuator 308 may be other types of electrical actuators in other embodiments. As a non-limiting example, the electrical actuator 308 may be an electromagnetic actuator.

As described above, the locking systems 100 may include various actuators for setting the locking member 110 to one of the retracted operation state and the extended operation state. As a non-limiting example, a user may set the locking system 100 to the retracted operation state when he or she desires to operate and move the wheelchair 10. As another non-limiting example, a user may set the locking system 100 to the extended operation state when he or she desires to lock the wheelchair 10 and prevent the wheelchair 10 from moving. As described below in further detail, the locking member 110 is configured to engage with a mating device when the locking system 100 is in the extended operation state in order to lock and prevent the wheelchair 10 from moving.

Figure 5A:
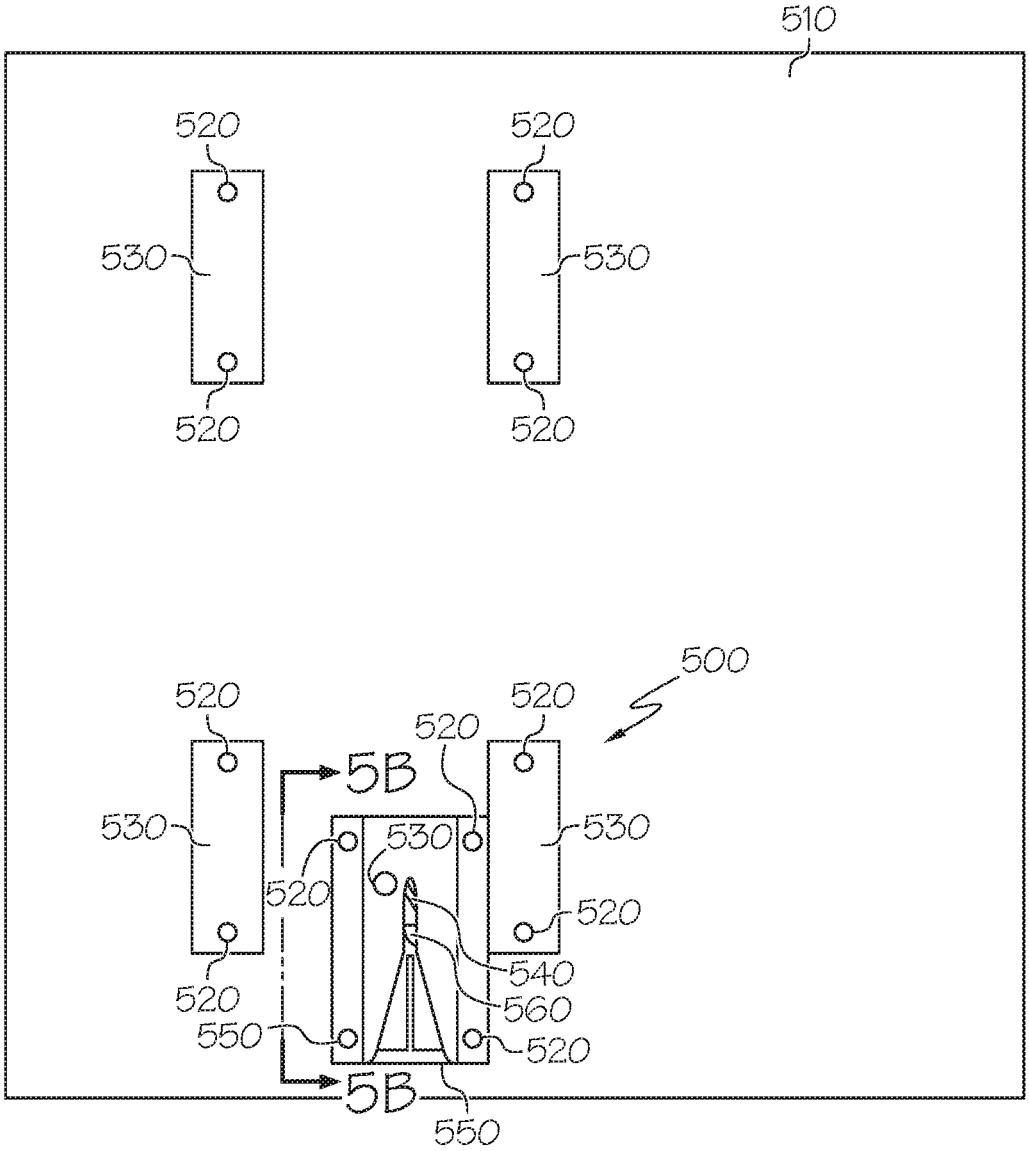
FIG. 5A schematically depicts an example mating device disposed on a surface according to one or more embodiments shown and described herein.
Figure 5B:
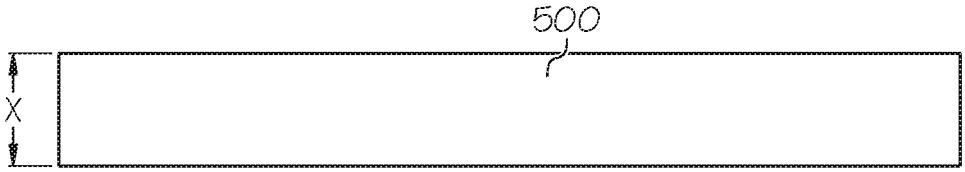
FIG. 5B schematically depicts a side view of an example mating device according to one or more embodiments shown and described herein.
Figure 5C:
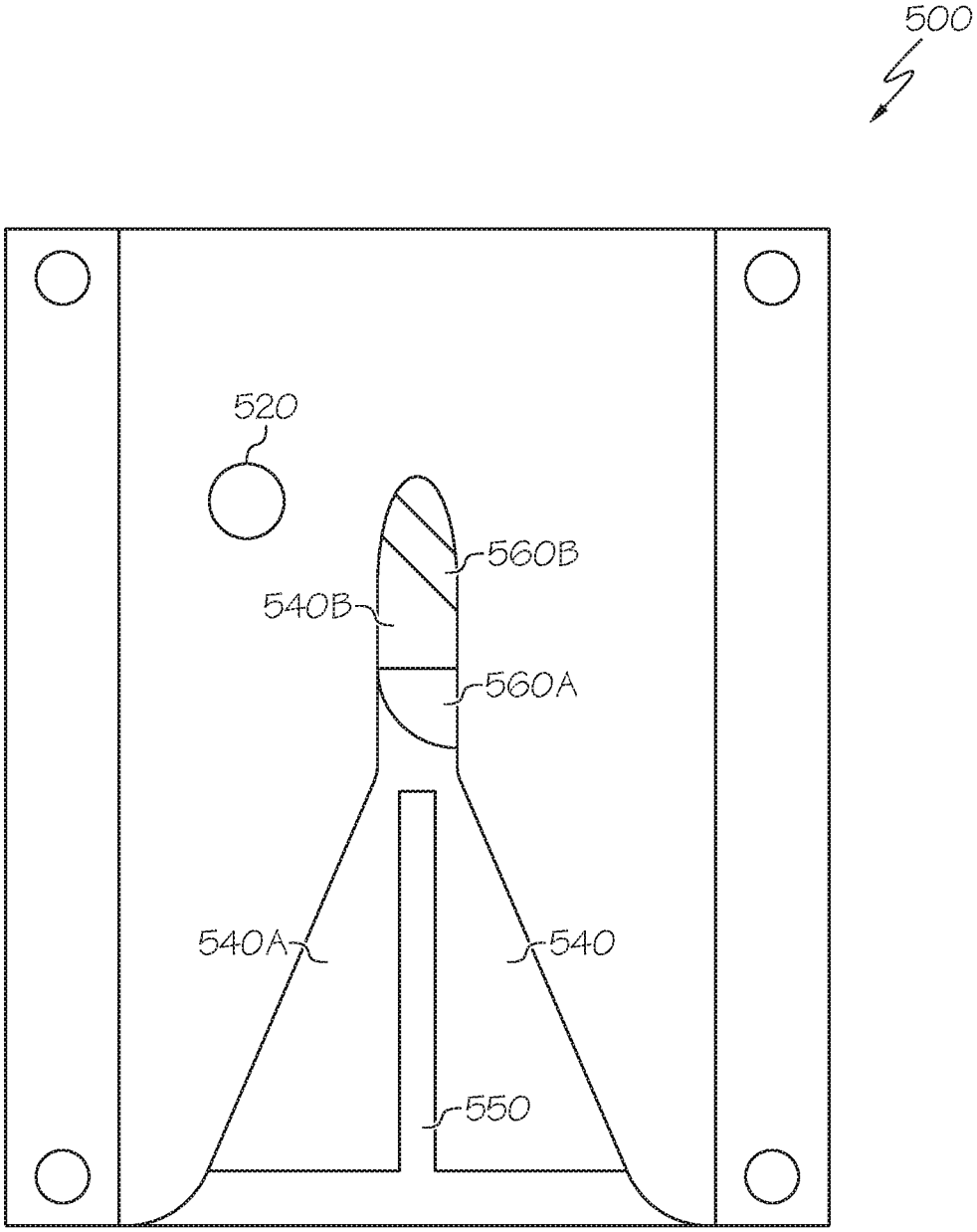
FIG. 5C schematically depicts exampling locking levers of a mating device according to one or more embodiments shown and described herein.

With reference to FIGS. 5A-5C, perspective view, side, and cross-sectional views, respectively, of mating device 500 are schematically depicted. In the illustrated embodiment, the mating device 500 may be disposed on a ground surface 510 (e.g., a floor of a vehicle), and the mating device 500 may extend from the ground surface 510 at height Xi, as illustrated in FIG. 5B. The mating device 500 may be secured to the ground surface 510 using fastening elements 520 (e.g., screws, rivets, bolts and nuts, etc.). Furthermore, the ground surface 510 may include a plurality of guides 530 that are secured to the floor using the fastening elements 520. In some embodiments, the plurality of guides 530 may visually assist a user in aligning the locking system 100 with the mating device 500.

The mating device 500 may include a groove 540, a support member 550, a first locking lever 560A, and a second locking lever 560B (collectively referred to as locking levers 560). In some embodiments, the groove 540 receives the locking member 110 when the locking system 100 is in the extended operation state, as described below in further detail with reference to FIGS. 6A-6D. Furthermore, when the locking system 100 is in the extended operation state, the locking member 110 engages with the locking levers 560 in order to securely attach the wheelchair 10 to the mating device 500, as described below in further detail with reference to FIGS. 6A-6C. In various embodiments, the support member 550 is configured to further reinforce the attachment of the mating device 500 to the ground surface 510.

Figure 6A:
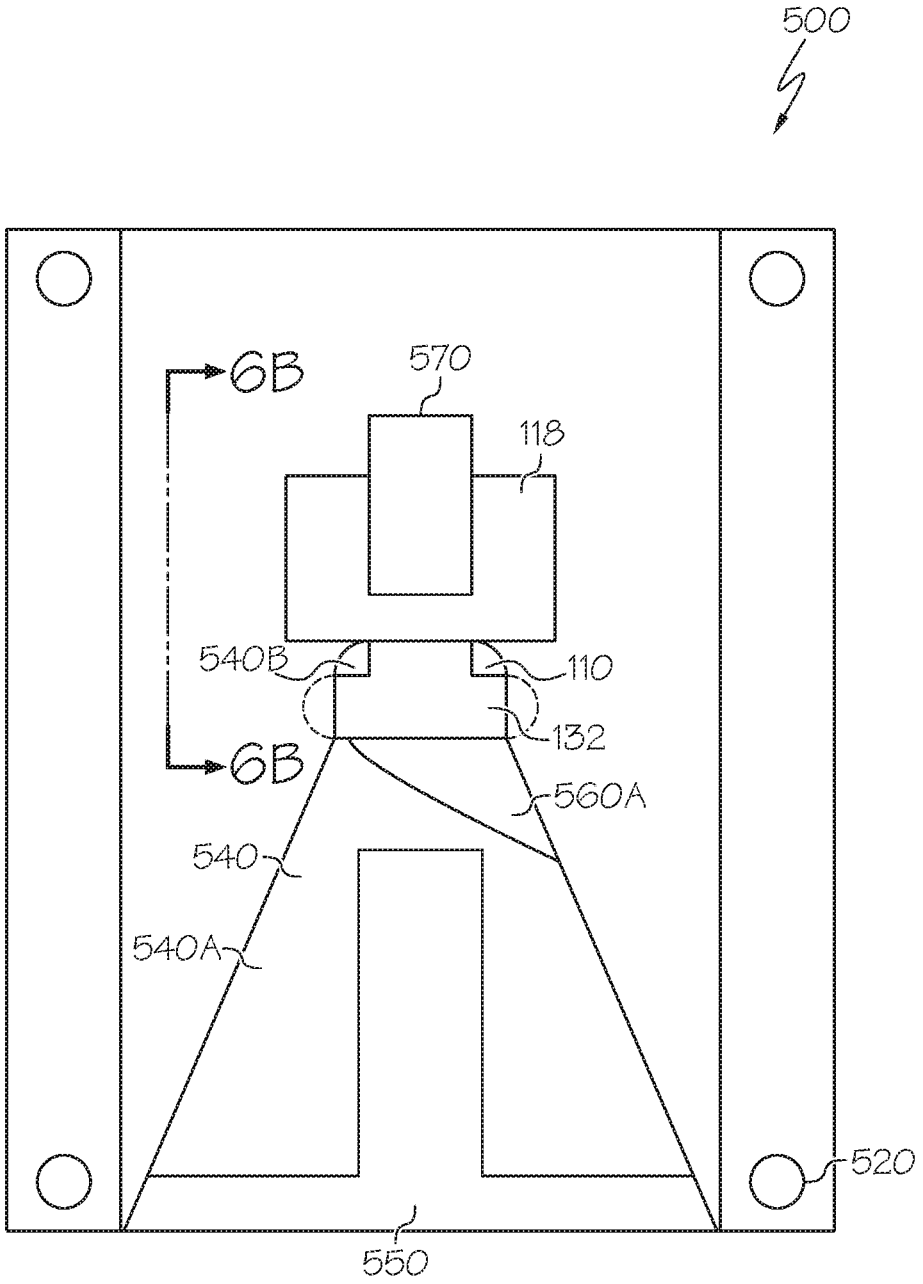
FIG. 6A schematically depicts a perspective view of an example locking system engaged with a mating device according to one or more embodiments shown and described herein.
Figure 6B:
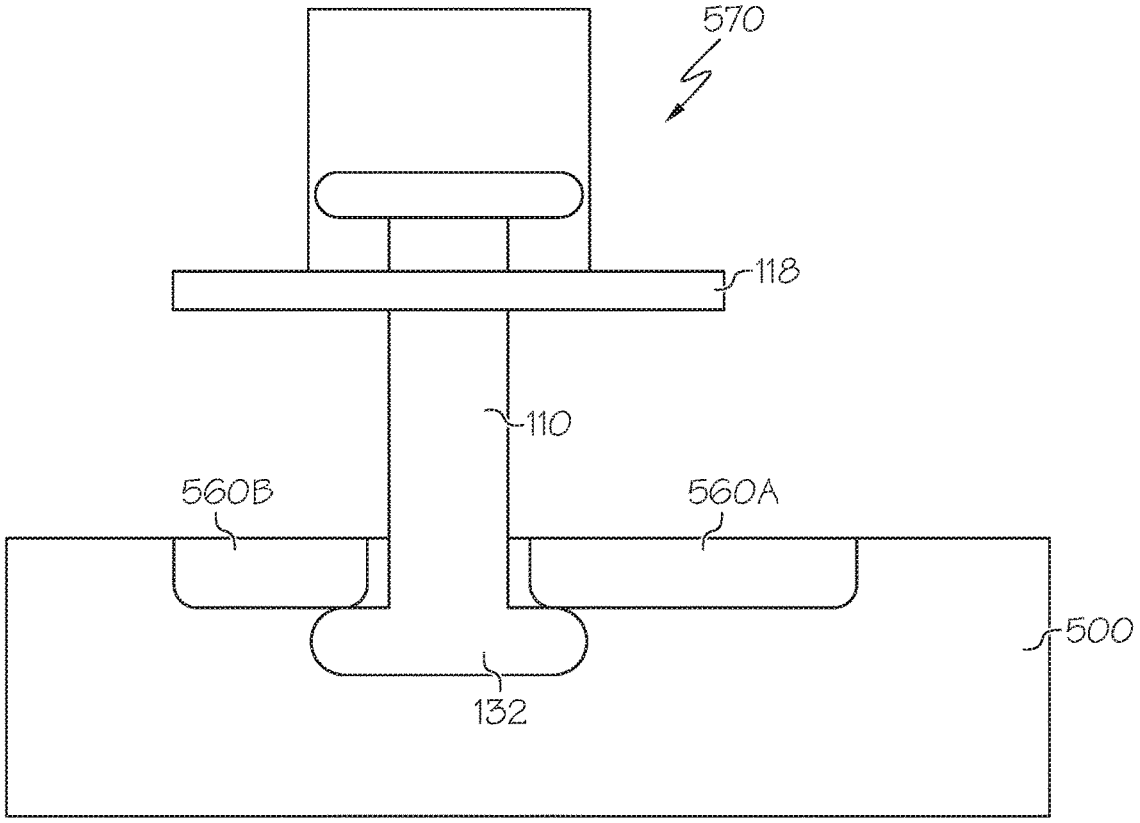
FIG. 6B schematically depicts a cross section view of an example locking system in an extended operation state and engaged with a mating device according to one or more embodiments shown and described herein.

With reference to FIGS. 6A-6B, a perspective and a partial cross section view, respectively, of a portion of the locking system 100 engaged with the mating device 500 are schematically depicted. In the illustrated embodiment, actuator 570 (i.e., one of actuators 108, 208, 308) is configured to set the locking system 100 to the retracted operation state by moving the locking member 110 in the downward direction (−Z), as described above. When the locking member 110 is extended in the downward direction, a user of the wheelchair 10 may guide the locking member 110 into the groove 540 of the mating device 500. As the user of the wheelchair 10 guides the locking member from a first portion 540A of the groove 540 into a locking portion 540B of the groove 540, the locking member 110 contacts the first locking lever 560A. Contacting the first locking lever 560A may cause the first locking lever 560A to rotate and subsequently lock the locking member 110 against the second locking lever 560B. While FIG. 6B illustrates gaps between the locking member 110 and the locking levers 560, in other embodiments, the locking member 110 may abut at least one of the locking levers 560.

Figure 6C:
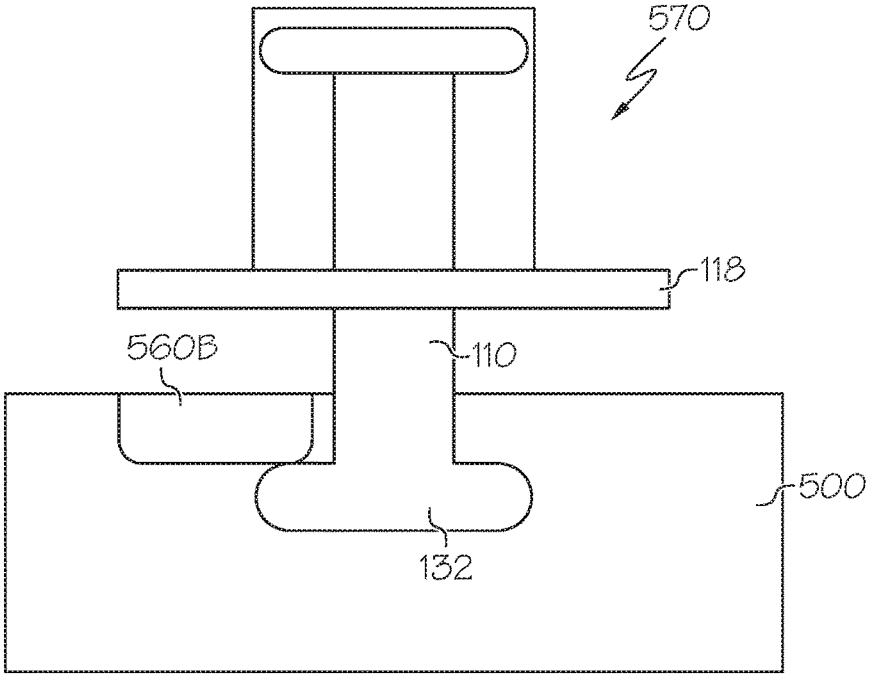
FIG. 6C schematically depicts a cross section view of an example locking system in a retracted operation state and disengaged with a mating device according to one or more embodiments shown and described herein.
Figure 6D:
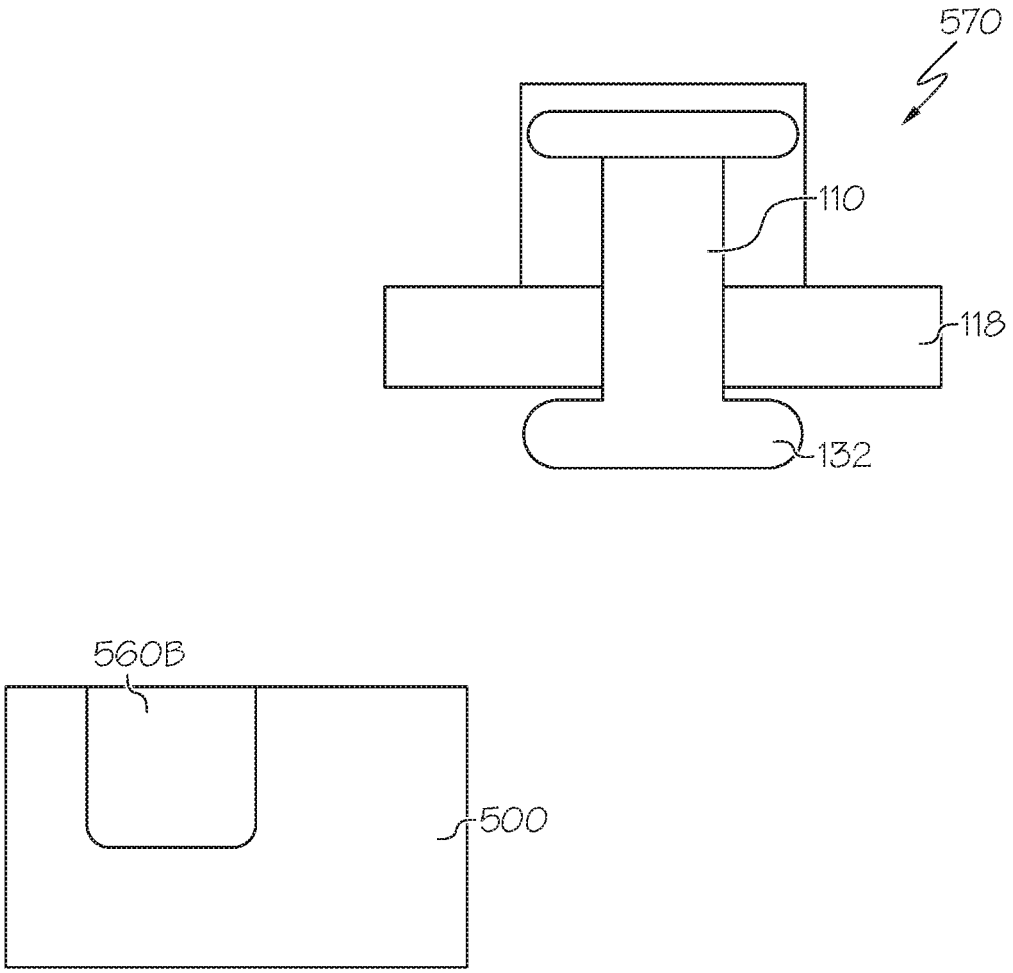
FIG. 6D schematically depicts another cross section view of an example locking system in a retracted operation state and disengaged with a mating device according to one or more embodiments shown and described herein.

With reference to FIGS. 6C-6D, partial cross section views of the locking system 100 disengaged with the mating device 500 are schematically depicted. In some embodiments, the mating device 500 may be communicatively coupled to a control device (not shown) that enables the user of the wheelchair 10 to unlock the mating device 500 and disengage the wheelchair 10 from the mating device 500. As a non-limiting example and as shown in FIG. 6C, the control device may transmit a signal to the mating device 500 causing the first locking lever 560A (not shown) to pivot in a direction such that the user may disengage the wheelchair 10 from the mating device 500. Subsequently, the user may set the locking system 100 to the retracted operation state by activating the actuator 570 to move the locking member 110 in an upward direction, as shown in FIG. 6D.

By incorporating the locking system 100 into the wheelchair 10, a user may lock and securely fix a position of the wheelchair 10 by extending the locking member 110 of the locking system 100 during the extended operation state. Furthermore, the locking system 100 enables a user of the wheelchair 10 to retract the locking member 110 during a retracted operation state, thereby enabling the user to avoid the terrain and/or other objects located underneath the wheelchair 10 during operation.

It will be apparent to those skilled in the art that various modifications and variations can be made without departing from the spirit or scope of the disclosure. Since modifications, combinations, sub-combinations and variations of the disclosed embodiments incorporating the spirit and substance of the disclosure may occur to persons skilled in the art, the disclosure should be construed to include everything within the scope of the appended claims and their equivalents.

The invention claimed is:

1. A locking system of a wheelchair, the locking system comprising:
- a locking member, an actuator, a locking frame, and an opening, wherein:
  - the opening is disposed within the locking frame;
  - the actuator is in communication with the locking member and is configured to move the locking member within the opening;
  - the actuator is operable in a retracted operation state and an extended operation state;
  - the actuator is configured to move the locking member in an upward direction when the locking system is set from the extended operation state to the retracted operation state;
  - the actuator is configured to move the locking member in a downward direction when the locking system is set from the retracted operation state to the extended operation state; and
  - the locking member is naturally biased in the extended operation state.

2. The locking system of claim 1, wherein the actuator is one of a pneumatic actuator, a hydraulic actuator, and an electrical actuator.

3. The locking system of claim 2, further comprising:
- a control device configured to set the actuator to one of the extended operation state and the retracted operation state;
- a pneumatic reservoir; and
- an pneumatic pump, wherein:
  - the actuator is the pneumatic actuator;
  - the pneumatic actuator is in communication with the locking member via a first path and a second path;
  - when the locking system is set from the retracted operation state to the extended operation state, the pneumatic actuator receives gas from the pneumatic reservoir via the pneumatic pump and the first path; and
  - when the locking system is set from the extended operation state to the retracted operation state, the pneumatic actuator receives the gas from the pneumatic reservoir via the pneumatic pump and the second path.

4. The locking system of claim 2, further comprising:
- a control device configured to set the actuator to one of the extended operation state and the retracted operation state;
- a hydraulic reservoir; and
- a hydraulic pump, wherein:
  - the actuator is the hydraulic actuator;
  - the hydraulic actuator is in communication with the locking member via a first path and a second path;
  - when the locking system is set from the retracted operation state to the extended operation state, the hydraulic actuator receives fluid from the hydraulic reservoir via the hydraulic pump and the first path; and
  - when the locking system is set from the extended operation state to the retracted operation state, the hydraulic actuator receives the fluid from the hydraulic reservoir via the hydraulic pump and the second path.

5. The locking system of claim 2, further comprising:
- a control device configured to set the actuator to one of the extended operation state and the retracted operation state, wherein:
  - the actuator is the electrical actuator;
  - the electrical actuator comprises a servo motor and a motor control circuit in communication with an electrical power source; and
  - the electrical actuator is set to one of the extended operation state and the retracted operation state based on a value output by the motor control circuit.

6. The locking system of claim 5, wherein the motor control circuit comprises an astable multivibrator circuit.

7. The locking system of claim 1, wherein the locking frame comprises a vertical portion and a flange portion, and wherein:

the flange portion is integrally coupled to the vertical portion at a first end of the vertical portion; and the opening is disposed within the flange portion.

8. The locking system of claim 7, wherein the locking frame comprises a horizontal portion, and wherein:

the horizontal portion is integrally coupled to the vertical portion at a second end of the vertical portion;

the horizontal portion is coupled to a coupling element of the locking system; and the coupling element is configured to couple the locking frame to a wheelchair frame of the wheelchair.

9. The locking system of claim 1, wherein the actuator is coupled to the locking frame.

10. The locking system of claim 1, wherein:

the locking member comprises a stop portion; and the stop portion is configured to prevent the locking member from extending from the locking frame in the downward direction beyond a threshold distance.

11. A wheelchair comprising:

a wheelchair frame; and a locking system comprising a locking member, an actuator, a locking frame, and an opening, wherein:

the locking frame is coupled to the wheelchair frame of the wheelchair;

the opening is disposed within the locking frame;

the actuator is in communication with the locking member and is configured to move the locking member within the opening;

the actuator is operable in a retracted operation state and an extended operation state;

the actuator is configured to move the locking member in an upward direction when the locking system is set from the extended operation state to the retracted operation state;

the actuator is configured to move the locking member in a downward direction when the locking system is set from the retracted operation state to the extended operation state; and the locking member is naturally biased in the extended operation state.

12. The wheelchair of claim 11, wherein the actuator is one of a pneumatic actuator, a hydraulic actuator, and an electrical actuator.

13. The wheelchair of claim 12, further comprising:

a control device configured to set the actuator to one of the extended operation state and the retracted operation state;

an air reservoir; and an air pump, wherein:

the actuator is the pneumatic actuator;

the pneumatic actuator is in communication with the locking member via a first path and a second path;

when the locking system is set from the retracted operation state to the extended operation state, the pneumatic actuator receives air from the air reservoir via the air pump and the first path; and when the locking system is set from the extended operation state to the retracted operation state, the pneumatic actuator receives the air from the air reservoir via the air pump and the second path.

14. The wheelchair of claim 12, further comprising:

a control device configured to set the actuator to one of the extended operation state and the retracted operation state;

a fluid reservoir; and a fluid pump, wherein:

the actuator is the hydraulic actuator;

the hydraulic actuator is in communication with the locking member via a first path and a second path;

when the locking system is set from the retracted operation state to the extended operation state, the hydraulic actuator receives fluid from the fluid reservoir via the fluid pump and the first path; and when the locking system is set from the extended operation state to the retracted operation state, the hydraulic actuator receives the fluid from the fluid reservoir via the fluid pump and the second path.

15. The wheelchair of claim 12, further comprising:

a control device configured to set the actuator to one of the extended operation state and the retracted operation state, wherein:

the actuator is the electrical actuator;

the electrical actuator comprises a servo motor and a motor control circuit in communication with an electrical power source; and the electrical actuator is set to one of the extended operation state and the retracted operation state based on a value output by the motor control circuit.

16. The wheelchair of claim 15, wherein the motor control circuit comprises an astable multivibrator circuit.

17. The wheelchair of claim 11, wherein the locking frame comprises a vertical portion and a flange portion, and wherein:

the flange portion is integrally coupled to the vertical portion at a first end of the vertical portion; and the opening is disposed within the flange portion.

18. The wheelchair of claim 17, wherein the locking frame comprises a horizontal portion, and wherein:

the horizontal portion is integrally coupled to the vertical portion at a second end of the vertical portion;

the horizontal portion is coupled to a coupling element of the locking system; and the coupling element couples the locking frame to the wheelchair frame.

19. The wheelchair of claim 11, wherein the actuator is coupled to the locking frame.

20. The wheelchair of claim 11, wherein:

the locking member comprises a stop portion; and the stop portion is configured to prevent the locking member from extending from the locking frame in the downward direction beyond a threshold distance.

* * * * *